US007209810B2

(12) United States Patent
Meyer et al.

(10) Patent No.: US 7,209,810 B2
(45) Date of Patent: Apr. 24, 2007

(54) LOCOMOTIVE LOCATION SYSTEM AND METHOD

(75) Inventors: Thomas J. Meyer, Marilla, NY (US); Thomas R. Metzger, Wheatfield, NY (US)

(73) Assignee: Lockheed Martin Corp., Bethesda, MD (US)

( * ) Notice: Subject to any disclaimer, the term of this patent is extended or adjusted under 35 U.S.C. 154(b) by 0 days.

(21) Appl. No.: 10/980,191

(22) Filed: Nov. 4, 2004

(65) Prior Publication Data

US 2005/0065726 A1 Mar. 24, 2005

Related U.S. Application Data

(63) Continuation-in-part of application No. 10/700,044, filed on Nov. 4, 2003, now abandoned, which is a continuation-in-part of application No. 10/041,744, filed on Jan. 10, 2002, now Pat. No. 6,641,090.

(51) Int. Cl.
*G01C 21/26* (2006.01)

(52) U.S. Cl. ..... 701/19; 701/220; 246/122 R

(58) Field of Classification Search ..... 701/23, 701/25, 200, 201, 220, 214, 19; 246/122 R, 246/167 R See application file for complete search history.

(56) References Cited

U.S. PATENT DOCUMENTS 5,902,351 A * 5/1999 Streit et al. ..... 701/220
6,408,254 B1 * 6/2002 Suter ..... 702/98
6,424,914 B1 * 7/2002 Lin ..... 701/214
6,831,599 B2 * 12/2004 Morgan ..... 342/357.14
2001/0020216 A1 * 9/2001 Lin ..... 701/216
2002/0010531 A1 * 1/2002 Hawthorne et al. ..... 701/19
2002/0072833 A1 * 6/2002 Gray ..... 701/19
2002/0103585 A1 8/2002 Biess et al.
2003/0236598 A1 * 12/2003 Antelo et al. ..... 701/19
2004/0006413 A1 * 1/2004 Kane et al. ..... 701/19
2004/0015275 A1 * 1/2004 Herzog et al. ..... 701/19
2004/0015276 A1 * 1/2004 Kane et al. ..... 701/19

* cited by examiner

*Primary Examiner*—Mark T. Le
(74) *Attorney, Agent, or Firm*—Wallace G. Walter

(57) ABSTRACT

A locomotive location system and method utilizes inertial measurement inputs, including orthogonal acceleration inputs and turn rate information, in combination with wheel-mounted tachometer information and GPS/DGPS position fixes to provide processed outputs indicative of track occupancy, position, direction of travel, velocity, etc. Various navigation solutions are combined together to provide the desired information outputs using an optimal estimator designed specifically for rail applications and subjected to motion constraints reflecting the physical motion limitations of a locomotive. The system utilizes geo-reconciliation to minimize errors and solutions that identify track occupancy when traveling through a turnout.

11 Claims, 16 Drawing Sheets

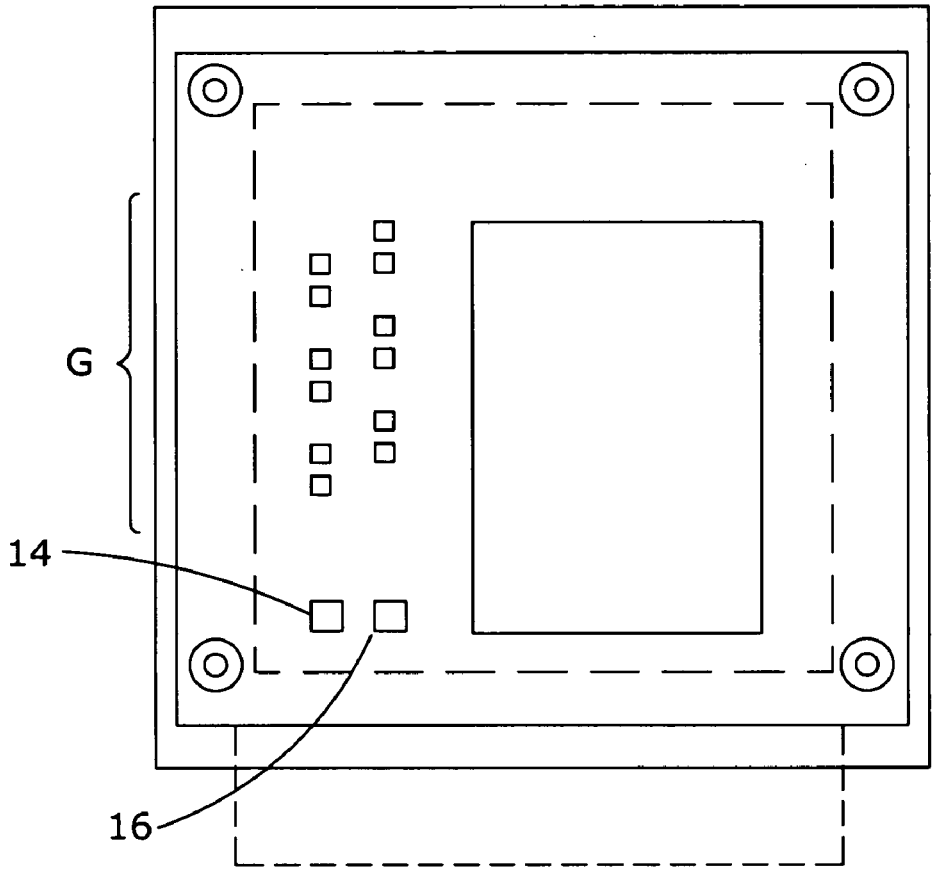
FIG. 1a
FIG. 1b
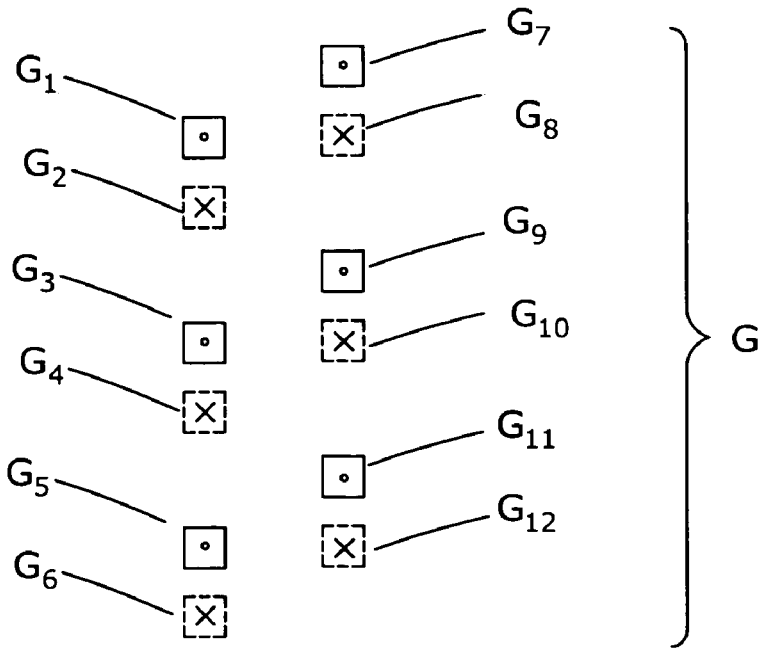

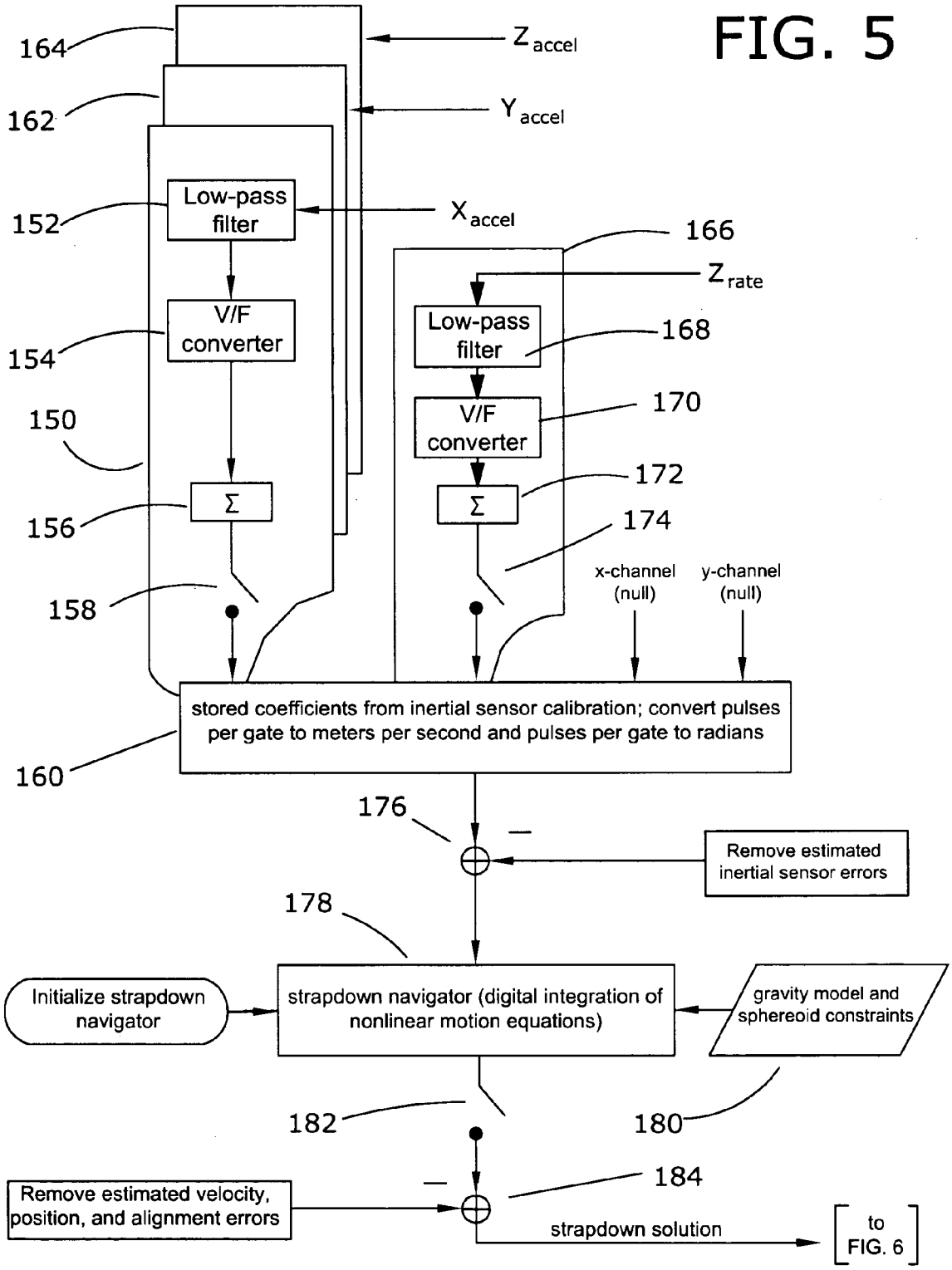
FIG. 5
164
162
152
154
150
156
158
160
166
168
170
172
174
176
178
180
182
184
Z accel
Y accel
X accel
Z rate
Low-pass filter
V/F converter
Σ
Low-pass filter
V/F converter
Σ
x-channel (null)
y-channel (null)
stored coefficients from inertial sensor calibration; convert pulses per gate to meters per second and pulses per gate to radians
Remove estimated inertial sensor errors
Initialize strapdown navigator
strapdown navigator (digital integration of nonlinear motion equations)
gravity model and sphereoid constraints
Remove estimated velocity, position, and alignment errors
strapdown solution
to FIG. 6

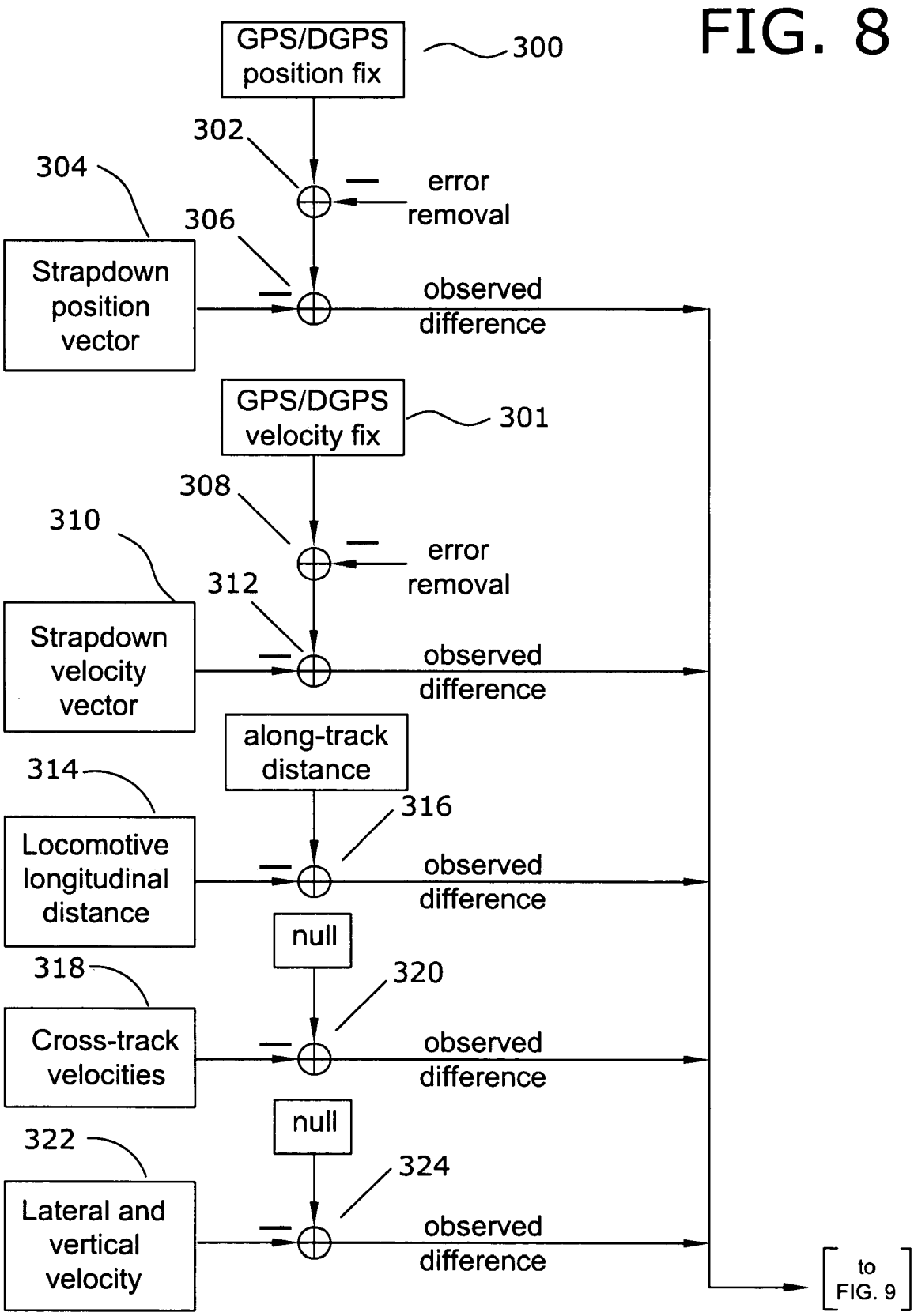
FIG. 8
GPS/DGPS position fix
300
302
304
306
error removal
Strapdown position vector
observed difference
GPS/DGPS velocity fix
301
308
310
312
error removal
Strapdown velocity vector
observed difference
along-track distance
314
316
Locomotive longitudinal distance
observed difference
null
318
320
Cross-track velocities
observed difference
null
322
324
Lateral and vertical velocity
observed difference
to FIG. 9

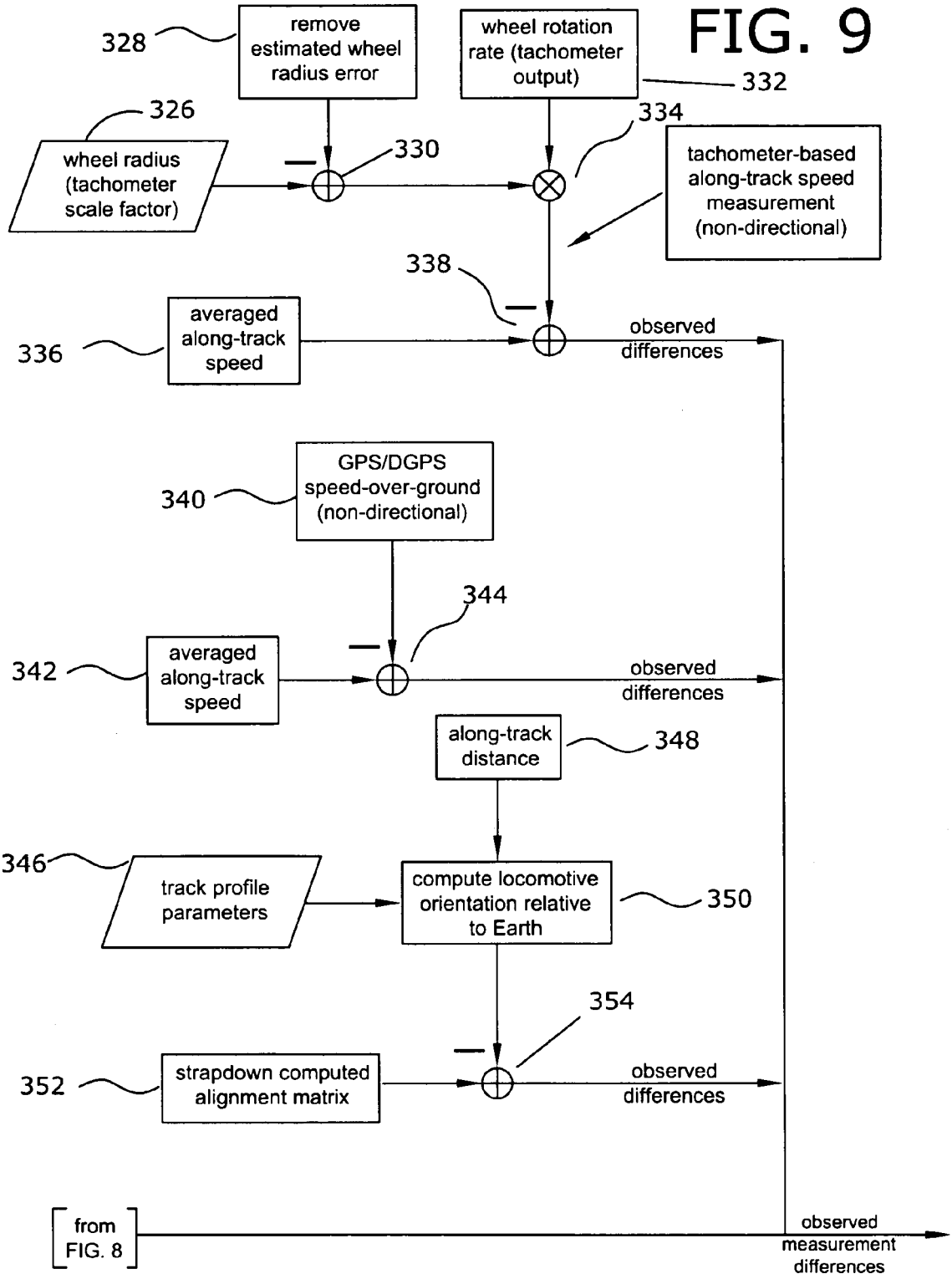
FIG. 9
328
remove estimated wheel radius error
wheel rotation rate (tachometer output)
332
326
wheel radius (tachometer scale factor)
330
334
tachometer-based along-track speed measurement (non-directional)
338
336
averaged along-track speed
observed differences
340
GPS/DGPS speed-over-ground (non-directional)
344
342
averaged along-track speed
observed differences
along-track distance
348
346
track profile parameters
compute locomotive orientation relative to Earth
350
354
352
strapdown computed alignment matrix
observed differences
from FIG. 8
observed measurement differences

LOCOMOTIVE LOCATION SYSTEM AND METHOD

CROSS-REFERENCE TO RELATED APPLICATION

This application is a continuation-in-part of commonly owned U.S. patent application Ser. No. 10/700,044 filed Nov. 4, 2003 (now abandoned) which, in turn, is a continuation-in-part of commonly owned U.S. patent application Ser. No. 10/041,744 filed Jan. 10, 2002, now U.S. Pat. No. 6,641,090.

BACKGROUND OF THE INVENTION

Various systems have been developed to track the movement of and location of railway trains on track systems.

In its simplest form, train position can be ascertained at a central control facility by using information provided by the crew, i.e., the train crew periodically radios the train position to the central control facility; this technique diverts the attention of the crew while reporting the train position, often requires several "retries" where the radio link is intermittent, and the position information rapidly ages.

Early efforts have involved trackside equipment to provide an indication of the location of a train in a trackway system. Wayside devices can include, for example, various types of electrical circuit completion switches or systems by which an electrical circuit is completed in response to the passage of a train. Since circuit completion switches or systems are typically separated by several miles, this technique provides a relatively coarse, discrete resolution that is generally updated or necessarily supplemented by voice reports by the crew over the radio link.

In addition, information from one or more wheel tachometers or odometers can be used in combination with timing information to provide distance traveled from a known start or waypoint position. Since tachometer output can be quite "noisy" from a signal processing standpoint and accuracy is a function of the presence or absence of wheel slip, the accuracy of the wheel-based distanced-traveled information can vary and is often sub-optimal.

Other and more sophisticated trackside arrangements include "beacons" that transmit radio frequency signals to a train-mounted receiver that can triangulate among several beacons to determine location.

While trackside beacon systems have historically functioned in accordance with their intended purpose, trackside systems can be expensive to install and maintain. Trackside systems tend not to be used on a continent-wide or nationwide basis, leaving areas of the track system without position-locating functionality (viz., "dark" territory).

More recently, global navigation satellite systems such as the Global Positioning System (GPS) and the nationwide Differential GPS (NDGPS), have been used to provide location information for various types of moving vehicles, including trains, cargo trucks, and passenger vehicles. GPS and similar systems use timed signals from a plurality of orbital satellites to provide position information, and, additionally, provide accurate time information. The time information can include a highly accurate 1 PPS (1-pulse-per-second) output that can be used, for example, to synchronize (or re-synchronize) equipment used in conjunction with the GPS receiver. The GPS/DGPS receivers require a certain amount of time to acquire the available satellite signals to calculate a positional fix. While the GPS system can be used to provide position information, GPS receivers do not function in tunnels, often do not function well where tracks are laid in steep valleys, and can fail to operate or operate intermittently in areas with substantial electromagnetic interference (EMI) and radio frequency interference (RFI). When a GPS system is operated on a fast-moving vehicle, the location information becomes quickly outdated. In addition, the accuracy of the GPS system for non-military applications is such that track occupancy (which track a train is on among two or more closely spaced tracks) cannot be determined consistently and reliably.

Current philosophy in train systems is directed toward higher speed trains and optimum track utilization. Such train systems require ever more resolution in train location and near real-time or real time position, distance from a known reference point, speed, and direction information. In addition to locating a train traveling along a particular trackway to a resolution of one or two meters, any train location system should be able to locate a train along one of several closely spaced, parallel tracks. Since track-to-track spacing can be as little as three meters, any train location system must be able to account for train location on any one of a plurality of adjacent trackways or determine track occupancy at a turnout or other branch point.

SUMMARY OF THE INVENTION

As used herein and in a general sense, the term "train" is treated as an equivalent of the term "equipped locomotive" or simply "locomotive" and reflects the fact that device(s) embodying the present invention is/are to be installed on a locomotive; it being assumed that any consist remains attached to and in known arrangement relative to the locomotive to form a train, e.g. a single locomotive pulling a long consist may comprise a train, and knowing the position of the locomotive subsequently determines position of any attached consist which thereby establishes the position of the train as a distributed entity, etc.

It is an objective of the present invention, among others, to provide a method for autonomous train location determination, i.e., one that solves the track occupancy problem in addition to positioning the locomotive along the track. By autonomous it is meant that track occupancy is to be determined without trackside equipment and in a minimum of elapsed time upon traversing a point of route divergence. The procedure required and the associated difficulties salient to determining track occupancy is herein referred to as the "turnout detection" or "track discrimination" problem.

Implicit in the above objective is a requirement for timeliness of applying turnout detection logic. Specifically, along-track position of the equipped locomotive must be known with sufficient accuracy to apply turnout detection logic during the window-of-time corresponding to the passage of the equipped locomotive over the point of switch. A problem arises, for example, when testing is too early or too late relative to the event of pulling a train onto a siding as this results in erroneously concluding the train remained on the mainline; this issue is the case even for otherwise flawless turnout detection logic since the duration of the event may be quite small for even moderate speeds of travel, e.g. 45 mph.

It is another objective of the present invention to provide a method for along-track position determination of sufficient accuracy to enable turnout detection in the necessary timely manner discussed above.

The present invention provides a method of determining track occupancy of a locomotive (or a locomotive and connected cars) as the locomotive passes from a first track to another track, for example, as the locomotive passes through a turnout onto either of a first or at least a second track including using an optimal estimator to accept linear and rotary inputs associated with the movement of a locomotive on a trackway to determine, either directly or indirectly, the distance traveled over the trackway and establishing at least first and second computational instances, respectively, for the first track and the second track using predetermined track parameters to identify one or the other (or both) instances that indicate track occupancy.

Other objectives and further scope of applicability of the present invention will become apparent from the detailed description that follows, taken in conjunction with the accompanying drawings, in which like parts are designated by like reference characteristics.

BRIEF DESCRIPTION OF THE DRAWING

FIG. 1*a* is a detailed view of a single circuit card assembly of FIG. 1;

FIG. 1*b* is a detailed view of an array or cluster of integrated rate gryo chips shown in FIG. 1*a'*

FIGS. 5 and 6 represent a process flow diagram showing the manner by which the data is processed;

FIGS. 8 and 9 illustrate a process flow diagram of the treatment of the measurement differences for the various inputs and also illustrates the combined contributions of the inertial and GPS/DGPS inputs;

DESCRIPTION OF THE PREFERRED EMBODIMENT

Figure 1:
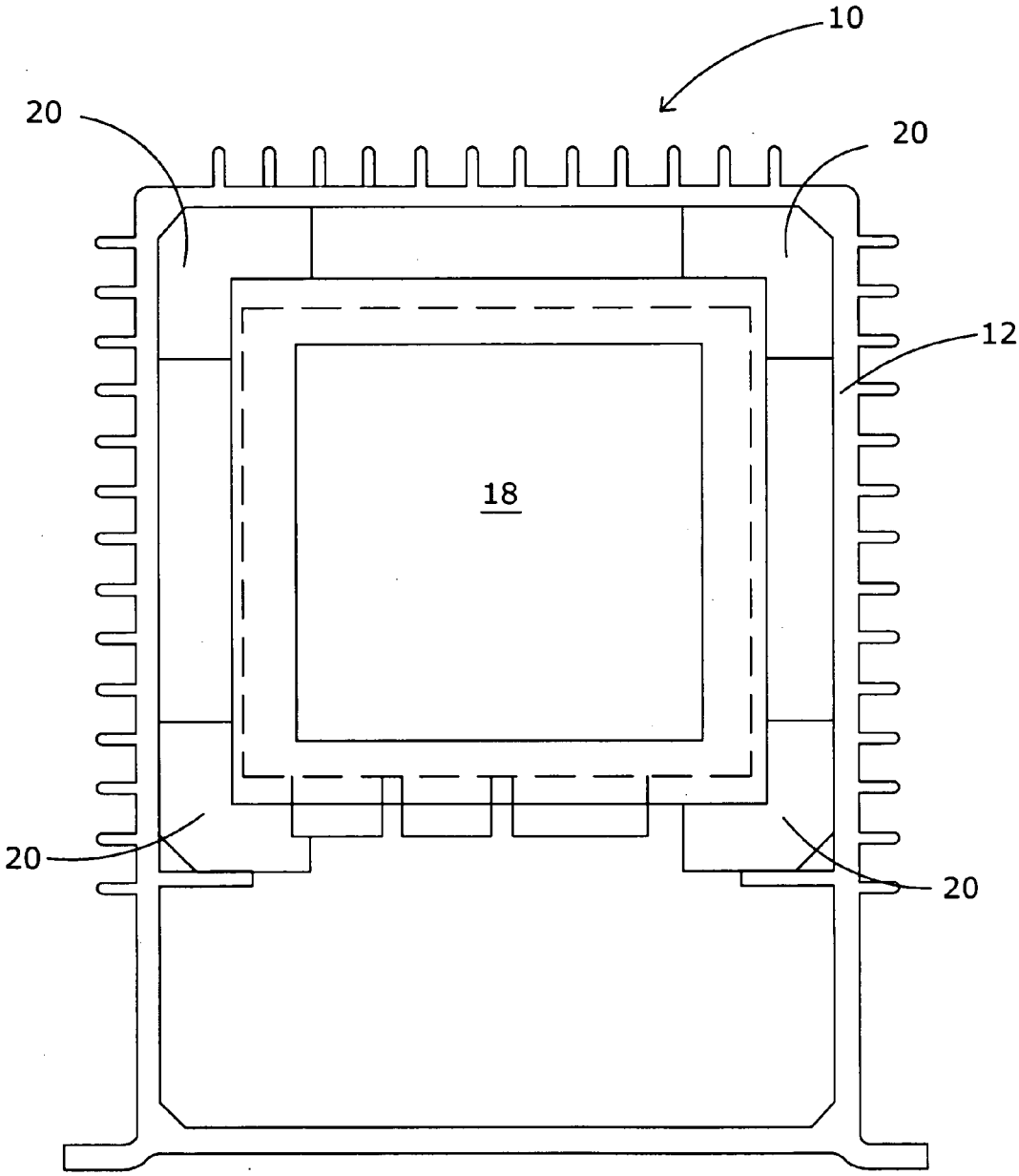
FIG. 1 is a representative elevational view of a first preferred form of the location determination module in accordance with the present invention.

The present invention provides the methods described above by implementing the process of FIG. 11 including a track profile model TPM, an inertial measurement unit IMU, a navigation module NAVM, exogenous measurement data input (i.e. data originating externally of the device) and corresponding model EXOM thereof, non-exogenous null pseudo-measurement data and corresponding model of physical constraints imposed thereof, and an optimal estimator OEST.

The track profile model TPM is used to represent, continuously as a function of the along-track position, the track centerline profile and includes a set of interpolation formulas (viz., for each of the centerline profile angles of latitude, longitude, grade, super-elevation, and heading) required to align an earth-fixed reference frame to a rail reference frame coincident with the track centerline and level across the two rails. The interpolation formulas require a discrete number of input parameters, referred to herein as track profile parameters, that once specified allow computing each profile angle at any along-track position within the range of applicability of the track profile parameter set. This discretization allows the geometry for considerable lengths of track to be encapsulated into a small data set.

The track profile model TPM is deliberately consistent with the methods for the design and construction of railroad track and includes via appropriate interpolation formulas, analytical representation of the geometry, i.e., profile, for each of tangent, curve, and spiral track sections. As described below, an enabling mechanism for optimal representation of railroad track, e.g. a minimum number of aforementioned track profile parameters is able to represent maximum lengths of track.

The inertial measurement unit IMU or equivalent dead-reckoning device provides to the navigation module NAVM, at minimum, the along-track acceleration and turn rate of the equipped locomotive, or equivalent thereof, e.g., a measure of moved distance during a known time interval together with a corresponding measured heading or change in heading, etc.

The navigation module NAVM computes at least two navigation solutions as its output. The first or primary of these navigation solutions is based exclusively on input from the inertial measurement unit IMU or equivalent, and is computed relative to an earth-fixed frame of reference. The second or auxiliary of these solutions combines the track profile input to the navigation module NAVM with the inertial or equivalent measurement data to compute a dead-reckoned solution corresponding to only that component of the inertial or equivalent measurement data projected onto (i.e., coincident with) the track profile. This computation necessarily involves the alignment of the track relative to the earth-fixed reference frame, i.e. the track profile. Another auxiliary solution may be computed by dead-reckoning only that portion of the inertial measurement data, or equivalent, aligned with the fore-aft or longitudinal axis of the locomotive. All three of these solutions are identical for the extraordinary circumstances wherein the inertial measurements or equivalent, the track profile, and the dead-reckoning computations are free of errors, and the locomotive axis, the track profile, and the inertial measurement unit IMU or equivalent all have coincident alignment relative to a common frame of reference. This situation is unattainable as a practical matter, however, and as described below, it is shown how the arrangement depicted in FIG. 11 nearly attains these extraordinary circumstances by uniquely solving for and removing such errors, and uniquely solving for a common frame of reference.

Predictions of incoming exogenous measurement data are computed periodically by the corresponding model of such measured data based on one or more of the aforementioned navigation solutions or various weighted combinations thereof. These predictions are differenced with the actual measurement data as it becomes available to form discrete error sequences henceforth referred to generally as "measurement residuals," the character of such being, by definition, indicative of a certain level of consistency between exogenous data and navigation computations internal to the device. (The track profile is not required by this computation.) Typical measurements include, but are not limited to, those provided by D/GPS (e.g. position fix data, speed and course over ground data, etc.) and those provided by various wheel-mounted tachometers, namely, speed data, or position increment data.

Opon receiving the inputted track profile and one or more navigation solutions or various weighted combinations thereof, the model of physical constraints PCM (FIG. 11) computes variables defined to quantify the level of agreement between the navigation solutions and kinematic relations known to govern the motion of a locomotive on a railroad track. The variables are predictive in nature and are defined in a manner such that, when zero-valued, the desired constraints are satisfied. Values of these variables are equivalently referred to herein as "constraint values." The predicted constraint values are differenced with the desired zero-values (referred to as "null pseudo-measurements") at high rate to form discrete error sequences henceforth referred to generally as "constraint violations," which, in lieu of the above discussion are seen to equal, mathematically, the negative of the constraint values. Examples of variables so defined include, but are not limited to those which quantify the opposing of prior knowledge that movement of the locomotive is directed along its longitudinal axis primarily (except for random, zero-mean lateral vibration), and also is aligned with the track profile of the occupied track.

The optimal estimator module OEST takes as inputs each of the abovementioned track profile, navigation solutions, inertial sensor data, measurement residuals, and constraint violations. Internal to the estimator is a process that models errors in the navigation solutions. The process model is generally a function of the track profile, the navigation solutions, and the inertial sensor data. Also internal to the estimator OEST are a model of incoming measurement residuals and a model of constraint violations, both of which are formulated in terms of the track profile and modeled navigation errors. These are used to predict values of incoming measurement residuals and constraint violations. The set of predicted values are subsequently differenced with the actual corresponding input values to form what is referred to henceforth as "filter residuals." The computation of the estimator OEST is arranged such that by feeding the correct and unique navigation errors back to the navigation module NAVM, upon which they are removed from the navigation solution, the filter residuals will be driven to zero in an appropriate average or mean-square sense, thereby confirming that the navigation solutions well-predict the exogenous measurement data, and that the physical constraints imposed are also satisfied. A Kalman filter (or other Bayesian estimator) is a suitable and preferred device for automating such computations.

Implicit in the discussion above is the assumption that the track profile input to the navigation module NAVM, the physical constraint PCM, and the estimator modules OEST, accurately represents the track occupied by the locomotive, from which movement upon results in the data generated by the inertial measurement unit IMU or equivalent. This condition is relied upon for the existence of a unique (i.e., mathematically observable) set of navigation errors that simultaneously drives the filter residuals to zero in the sense also described above, i.e., a set of errors that can be computed by the estimator while operating in feedback arrangement with the navigator and accepting as inputs the measurement residuals and constraint violations as shown. Only when this condition exists is there balance or agreement between what the inertial measurement unit senses, what the navigation module NAVM predicts, what the exogenous measurements indicate, what the physical constraints impose, what the estimator OEST computes as errors, and what the estimator outputs as filter residuals.

Figure 11:
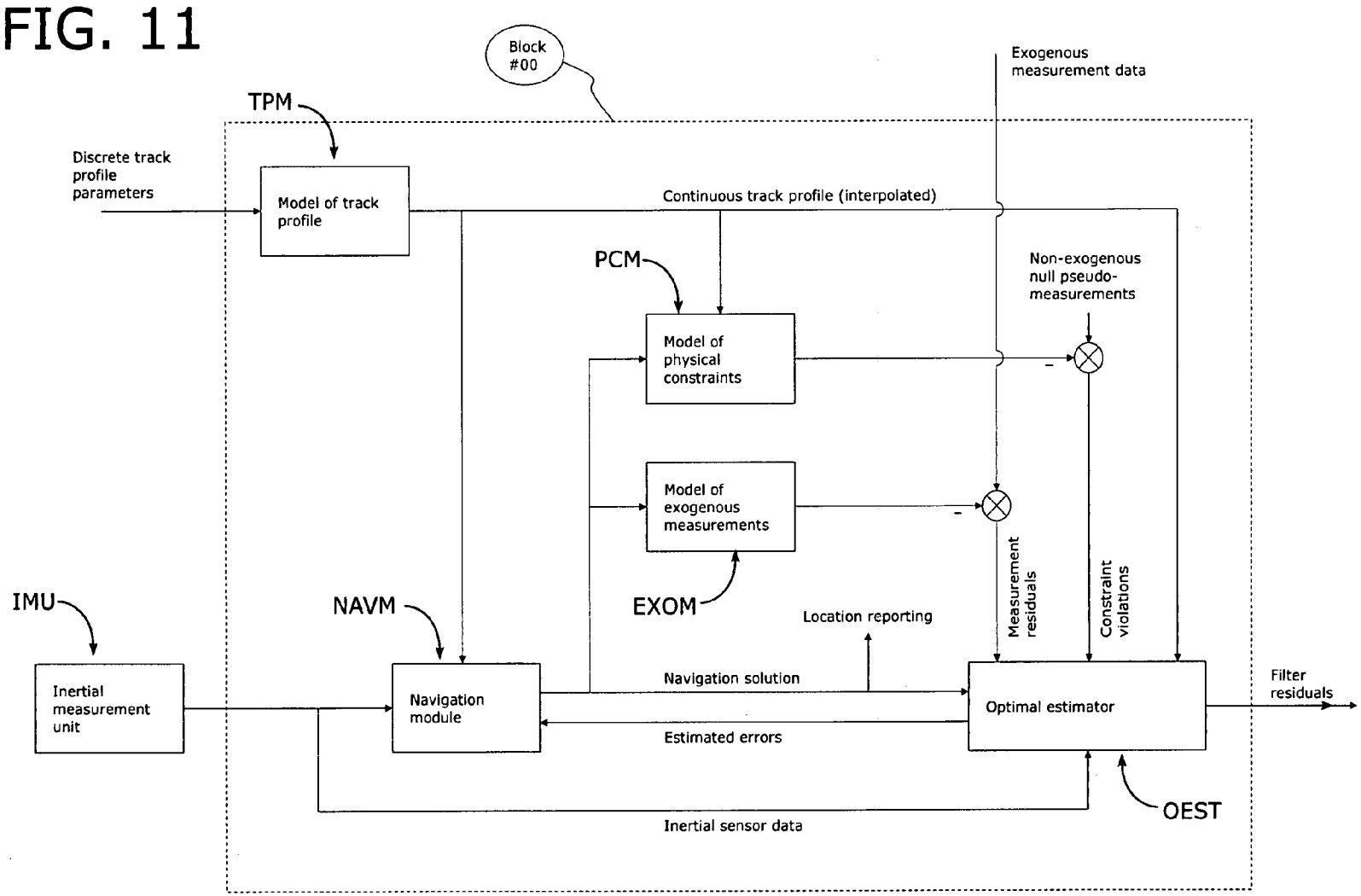
FIG. 11 is an overall block/function diagram of a preferred method showing the combined data and navigation device fusion.

Simultaneously and because of this unique balance, it is possible to solve in advance for the effects on the filter residuals due to erroneous track profile input. This provides a mechanism to solve the track discrimination problem. Namely, a second (computational) instance of FIG. 11 is begun just prior to traversing a turnout (but sharing with the first instance the common inertial measurement unit IMU (or equivalent) and exogenous measurement data). This second instance is supplied with the discrete track profile parameters for the alternate track beginning at the point of divergence. The filter residuals for both instances are monitored as the locomotive traverses the turnout, upon which in a timely manner the filter residuals produced by the estimator OEST given the incorrect track profile deviate in a known manner from their aforementioned zero-mean characteristics. Upon observing this, it is concluded unambiguously which computational instance corresponds to the correct track profile, and equivalently which track the locomotive occupies. The track detection problem is thus solved, whence the computational instance corresponding to the incorrect track is terminated.

As described below, the above method of applying physical constraints makes readily available a large set of filter residuals for monitoring, i.e., the method is not limited to examining merely one signal derived from, say, gyro-indicated versus track profile-indicated heading differences. Also, because the physical constraints can be applied at a high rate, the method is not troubled by delays associated with necessary accumulation of data points available at low rates as is done in many map-matching methods proposed elsewhere, wherein position fix data is overlaid on potential travel paths and statistical goodness-of-fit measures are used to select the path taken. Thus the present invention addresses the temporal aspect of the turnout detection problem.

Although the filter residuals themselves comprise stochastic sequences, upon inputting the incorrect track profile as described above, the respective changes in properties thereof are solved for deterministically, and in advance of traversing a turnout, and the turnout detection is accomplished with redundancy by virtue of the availability of multiple filter residuals.

Position information from a plurality of trains can be provided to a central track control or command center to allow more efficient utilization of the train/track system.

A train location determination system (LDS) in accordance with the present embodiment is shown in a generalized physical form in FIG. 1, designated generally therein by the reference character 10. The physical presentation of FIG. 1 is merely representative of the various ways in which a location determining system in accordance with the present method can be configured. Configured as shown, the location determining system 10 includes a generally vertically aligned housing 12 that includes a set of circuit card assemblies 18 is mounted in the upper portion of the housing 12; the circuit card assemblies 18 effects signal conditioning and processing as explained below. In the preferred embodiment, the circuit cards conform to the PC/104 standard which provides for interconnectable circuit cards that use common PC bus communications protocols within a standard form-factor; as can be appreciated, the processing electronics can use other industry standard or proprietary protocols. The circuit card assemblies 18 are partially isolated from ambient vibration by elastomeric vibration isolators 20. While not specifically shown in FIG. 1, various devices, boards, etc. within the system are inter-connected by various cables and connectors.

As shown in FIG. 1*a*, one of the circuit card assemblies 18 includes first and second accelerometers 14 and 16, typically in the form of "micro-electromechanical machine" (MEMS) integrated circuits of the general type described, for example, in U.S. Pat. No. 4,663,972. In addition, a cluster of gyro chips G is provided. As explained below, the gyro chip cluster G and the first accelerometer 14 and the second accelerometer 16 provide, respectively, rate of turn and three-axis acceleration information to the processing electronics.

As shown in the schematic detail of FIG. 1*b*, the gyro chip cluster G is divided into two sets of six gyro chips of which six chips (solid-line illustration are mounted on the front side of the circuit card assembly 18 (the visible side in FIG. 1*b*) and another set of six chips (dotted-line illustration) mounted on the other or backside of the circuit card assembly 18 shown in FIG. 1*b*. Each gryo chip has a sensitive axis; the frontside chips in FIG. 1*b* are aligned with their respective sensitive axes pointing outwardly of the front side of the circuit board (as indicated by the circles) and the backside chips are aligned with their respective sensitive axes pointed in the opposite direction (as indicated by the cross symbols).

Suitable gyro chips include the ADXRS150 sold by Analog Devices, Inc. of Norwood Mass. which operates on the principle of a resonator gyro in which two polysilicon sensing structures each contain a dither frame that is electrostatically driven to resonance to produce the necessary velocity element to generate a Coriolis force during angular rates. Capacitive pick-offs sense any Coriolis forces generated as a consequence of any angular rate. The resulting signal is processed to provide the desired electrical signal rate output. Integrated MEMS rate gyro structures are described in more detail in U.S. Pat. Nos. 6,122,961 and 6,505,611, both entitled "Micromachined Gyros" and assigned to Analog Devices, Inc.

In the embodiment of FIGS. 1*a* and 1*b*, plural gyro chips are used in an ensemble arrangement, array, or cluster to add sensor redundancy and to gain the advantage of time-averaged outputs from the plurality of gyro chips $G_1, \ldots G_{n-1}, G_n$. Since one cluster of gyro chips $G_1$, $G_3$, $G_5$, $G_7$, $G_9$, and $G_{11}$ (on the front side of the circuit card assembly 18, for example) has their various sensitive axes in one direction and the other cluster of gyro chips $G_2$, $G_4$, $G_6$, $G_8$, $G_{10}$, and $G_{12}$ (on the other side of the circuit card assembly 18) has their various sensitive axes aligned in the opposite direction, common mode error sources, such as gyro vibration rectification, can be rejected.

Figure 1C:
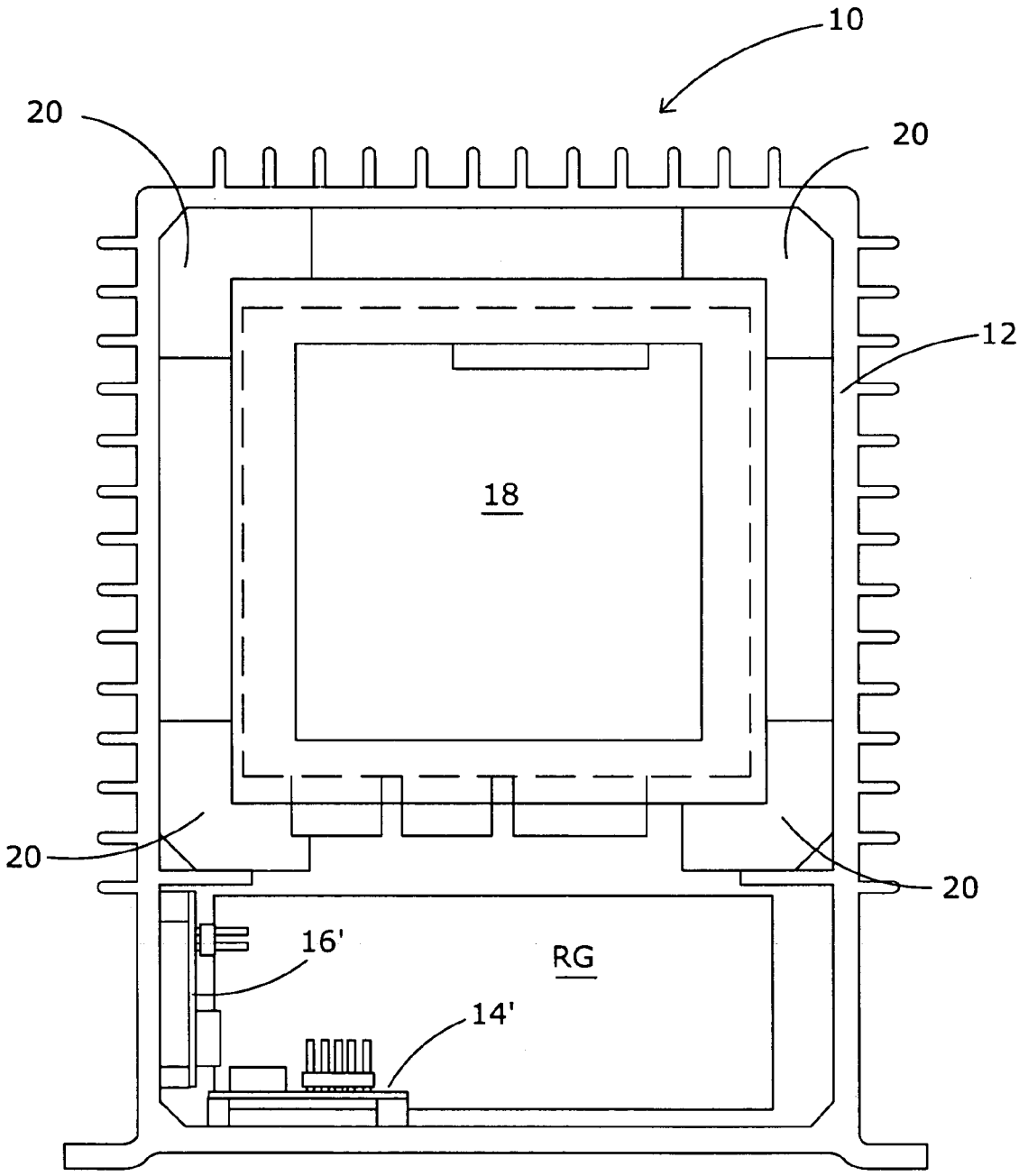
FIG. 1*c* is a representative elevational view of another form of the location determination module in accordance with the present invention.

As second embodiment in accordance with the present invention is shown in FIG. 1*c*. As shown therein, the location determining system 10 includes a generally vertically aligned housing 12 that includes a rate gyro RG, a first accelerometer board 14' and an orthogonally aligned second accelerometer board 16'. The various boards and devices are inter-connected by various cables and connectors (not specifically shown). As explained below, the rate gyro RG and the first accelerometer board 14 and the second accelerometer board 16 provide, respectively, rate of turn and three-axis acceleration information to the processing electronics.

A set of circuit card assemblies 18 is mounted in the upper portion of the housing 12; the circuit card assemblies 18 effects signal conditioning and processing as explained below. As in the case of the embodiment described above in FIGS. 1, 1*a*, 1*b*, and 1*c*, the circuit cards conform to the PC/104 standard which provides for interconnectable circuit cards that use common PC bus communications protocols within a standard form-factor; as can be appreciated, the processing electronics can use other industry standard or proprietary protocols. The circuit card assemblies 18 are partially isolated from ambient vibration by elastomeric vibration isolators 20.

The rate gyro RG is preferably a commercially available fiber optic gyro (FOG) that can include integrated electronics and which provides turn rate information $Z_{GYR}$ as an output.

The accelerometers of FIG. 1*c* are preferably of the microelectronic type in which a pendulum is etched from a silicon substrate between conductive capacitor plates; acceleration-induced forces on the pendulum cause changes in the relative capacitance value; an integrated restoring loop (or equivalent) provides an indication of the acceleration being experienced along the sensitive axis. While microelectronic devices are preferred, conventional pendulum type accelerometers, with or without restoring loops, are not excluded.

The first accelerometer board 14 includes a sufficient number of devices to provide acceleration information along the direction of travel axis (i.e., the longitudinal, along-track, or Y axis) and along the side-to-side axis (i.e., the lateral or X axis). In a similar manner, the second accelerometer board 16 provides acceleration information in the up-down direction (i.e., Z-axis). If desired, redundant accelerometers can be provided on one or more axes to impart an added measure of reliability to the system. Thus, the various accelerometers provide respective $X_{ACC}$, $Y_{ACC}$, and $Z_{ACC}$ data.

As can be appreciated, the housing 12 is secured to a mount within or on a portion of the train (e.g., the locomotive cab) in such a way that the various sensing axes are appropriately aligned with the locomotive longitudinal (i.e. direction of travel), lateral, and vertical coordinates.

The location determining system 10 communicates with other on-board equipment using a network interface as applicable. Modern locomotives have an on-board network for interconnection with various devices and an on-board computer (not specifically shown) capable of supplying track data to the location determination system if needed. Alternatively, the LDS may store all track data required for a particular route. A suitable and preferred network interface conforms to the LonWorks standard, although other network protocols, such as the Ethernet standard (and its variants), are equally suitable.

Figure 2:
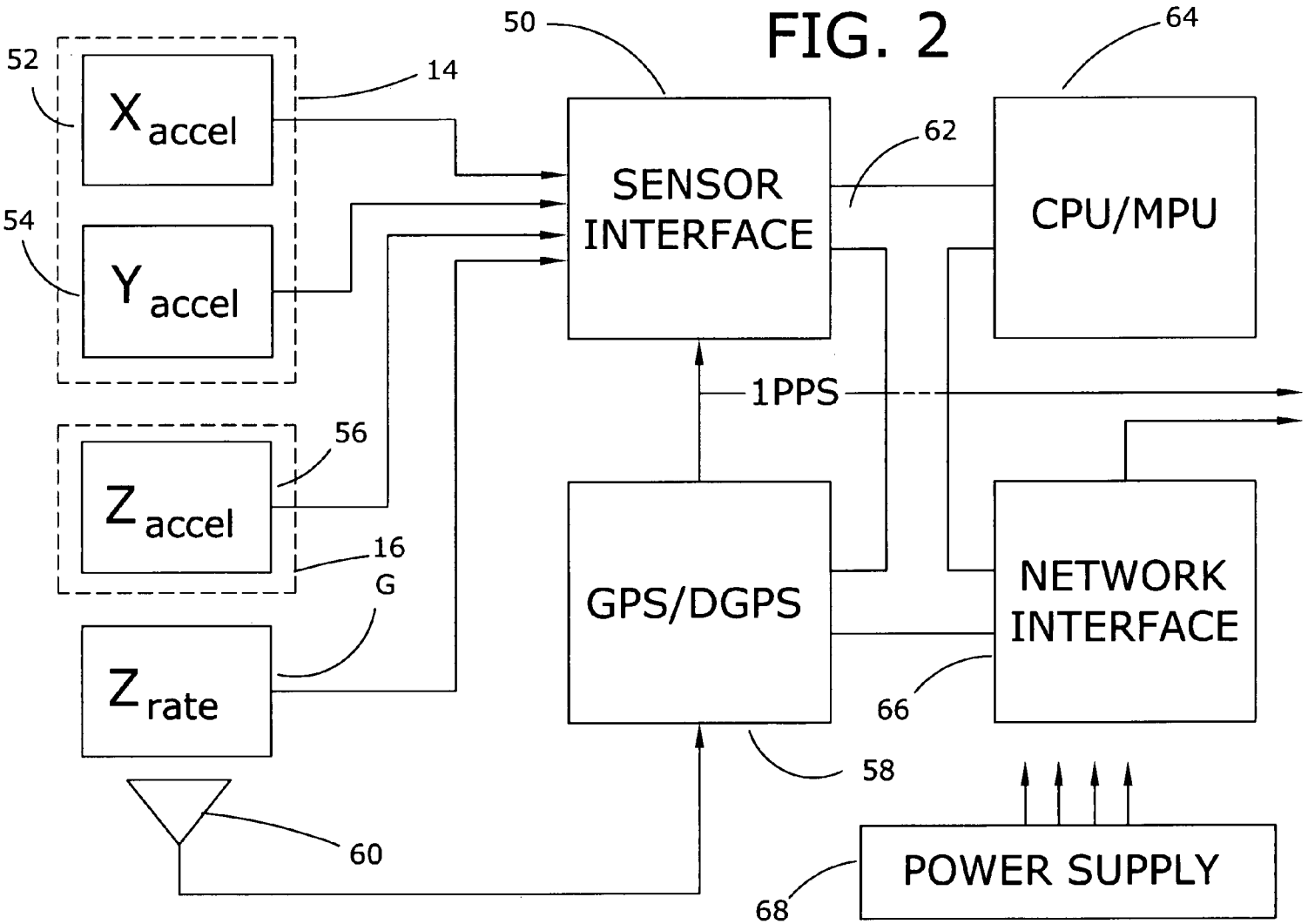
FIG. 2 a schematic block diagram of the major functional components of the preferred embodiment.

The location determining system 10 is functionally organized as shown in block form in FIG. 2. As shown, a sensor interface 50 accepts the $X_{ACC}$ and $Y_{ACC}$ outputs from the various accelerometers 52 and 54 (i.e., the accelerometer 14 of FIGS. 1–1*b* or 14' of FIG. 1*c*), the $Z_{ACC}$ output from an accelerometer 56 (i.e., the accelerometer 16 of FIGS. 1–1*b* or 16' of FIG. 1*c*), and output from the rate gyro G.

A GPS receiver 58, including a low-profile locomotive roof-mounted antenna 60, also provides an input to the sensor interface 50. The GPS receiver 58 can take the form of a commercial chipset that includes both GPS and DGPS functionality and is preferably mounted on one of the circuit cards of the circuit card assembly 18 (FIG. 1). The sensor interface 50 and the D/GPS receiver 58 communicate over a bus 62 with a processing unit 64 and a network interface 66 that interfaces with the locomotive network to provide periodic position reports. A power supply 68 provides appropriately conditioned power voltages to the various devices.

In FIG. 2, processing is shown to take place in the processing unit 64; as can be appreciated, all or part of the processing (as described in FIG. 3) can take place in the processing unit 64, the on-board computer of the locomotive (not shown), or sub-portions of the processing can be effected in distributed stored-program microprocessors or specifically configured application specific integrated circuits (ASICS). In addition, data can be stored in and/or retrieved from various memory devices including traditional hard disc storage, various types of static RAM (SRAM), or dynamic RAM (DRAM).

Figure 3:
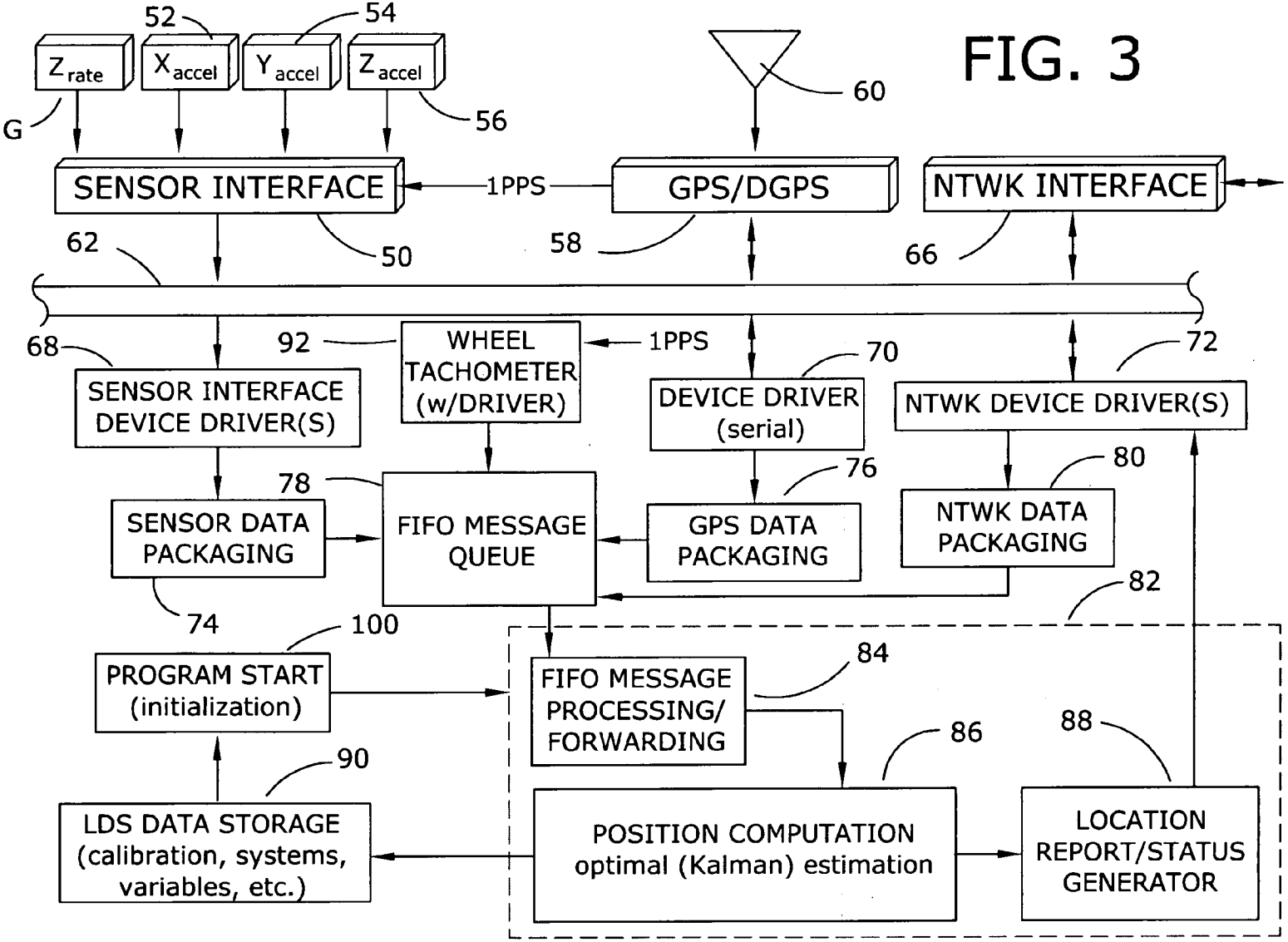
FIG. 3 is a block diagram showing the interfacing of the hardware components and the software-implemented components of the preferred embodiment.

The processing organization of the location determining system 10 and its interface with the functional organization of FIG. 2 is shown in schematic form in FIG. 3. As shown, the bus 62 functions to interconnect the rate gyro G information and the accelerometers 52, 54, and 56 information through the sensor interface 50 with the D/GPS receiver 58 and the network interface 66.

A sensor interface device driver 68, a D/GPS device driver 70, and a network device driver 72 interconnect with and through the bus 62; the drivers 68 and 70 condition their respective signals for subsequent processing.

The output of the sensor interface device driver 68 is provided to a sensor data packager 74 and the output of the device driver 70 is provided to a D/GPS data packager 76 with their respective outputs provided to a first-in first out (FIFO) message queue 78. In a similar manner, the network device driver 72 outputs to a network data packager 80, which, in turn, outputs to the FIFO message queue 78. The various device drivers function to condition the output signals for a common data-packaging protocol and are specific to the operating system used. For example, where the QNX embedded operating system is used, the various drivers conform to the QNX protocol.

The output of the locomotive wheel tachometer is conditioned and processed through a wheel tachometer block 92 and likewise provided to the FIFO message queue 78.

A main process module 82 (dotted-line illustration) includes a FIFO message processor 84 that forwards the packaged messages from the sensor functions, the D/GPS receiver functions, and the network into a position computation functional block 86. The position computation functional block 86, as explained more fully below, outputs position on a continuous, near-continuous, or periodic basis to a location report/status generator 88 and optionally to a data storage unit 90. As mentioned above, the data storage function can be localized in one data storage unit or can be distributed across a number of data storage units of various types.

The output of the location reports/status generator 88 is provided through the network device driver 72 through the bus 62 to the network interface 66 that connects for the locomotive on-board computer (which may share some or all of the processing of FIG. 3) for on-board display and communication (via a RF link) to one or more train control centers. In general, the location report preferably includes track occupancy, location along occupied track from known reference point, speed, direction of travel, a stopped/not-stopped indication, confidence intervals for each of these outputted data, an indication of the information used to compute the location solution, a conventional Built-in-Test (BIT) status indicator, and a validity flag that indicates whether or not the above data included in the location report is of questionable integrity.

A program start functional block 100 connects to the data storage unit 100 and to the main process module 82 to start the overall processing sequence.

Post-initialization process flow is shown in FIGS. 5–10. As shown in FIG. 5, the X direction acceleration (along the side-to-side or lateral direction) is addressed in process 150. The $X_{accel}$ value, i.e., a hardware-provided analog voltage that is proportional to the sensed acceleration, is input to a low-pass filter 152; the low-pass filter eliminates frequencies beyond the motion of interest. The filtered voltage is then supplied to a voltage-to-frequency converter 154 that outputs a pulse stream, the frequency of which is proportional to input voltage (and the sensed acceleration). The pulse stream is then summed in an accumulator 156 over recurring fixed count periods. The output of the accumulator 156 is then gated and reset at 158 (the pulse count is proportional to integrated voltage, i.e., the velocity increment) and provided to a scale factor/units conversion function block 160 that changes the gated pulse values to a meters/second value and resolved along the orthogonal axes of the unit (versus the sensor axes).

In a similar manner, processes 162 and 164 address the $Y_{accel}$ and the $Z_{accel}$ inputs.

In a manner analogous to the processing of the acceleration information, the Z axis rate-of-turn information is addressed in process 166. The Z rate value, i.e., a hardware-provided analog voltage that is proportional to the turn rate about the Z axis, is input to a low-pass filter 168. The filtered voltage is then supplied to a voltage-to-frequency converter 170 that outputs a pulse stream, the frequency of which is proportional to input voltage (and the sensed rate-of-turn information). The pulse stream is then summed in an accumulator 172 over recurring fixed count periods. The output of the accumulator 172 is then gated and reset at 174 (the pulse count is proportional to integrated voltage, i.e., the rotation increment) and provided to the scale factor/units conversion function block 160 that changes the gated pulse values to a radian value resolved along the orthogonal axes of the unit.

As represented by the two null (i.e., zero) channels inputting to the scale factor/units conversion function block 160, turn rates corresponding to pitch and roll are zero, since the locomotive is confined to a trackway and pitch/roll values are negligible.

Position computation in the main process module 82 is effected through a navigator, and a Bayesian estimator used to correct errors inherent to the navigator. For present purposes, the estimator is considered a data fusion methodology wherein upon receiving new or additional data, previously available information can be updated and its accuracy or quality thereby improved. In estimation terminology, the previous information is referred to as a priori data, the new data is referred to as the conditioning data set, and the updated information is referred to as the a posteriori data. Thus, the a posteriori data is conditioned by all data that has been used to update and improve it. Applied to the LDS, the a priori data comprises a mathematical model of errors inherent to the LDS navigator and errors inherent to various measurement devices. Examples of the former errors may include accelerometer and gyro biases; examples of the latter errors may include D/GPS position fix bias and error in the tachometer's distance-per-pulse value. The conditioning data set comprises D/GPS position fixes and speed and course over ground, tachometer pulse count data, and constraints representing kinematics relations known to govern the motion of a locomotive. A Kalman filter is the algorithm used to condition the a priori data with the above data set. As the a priori data improves, i.e., as estimated navigation errors converge, the LDS navigator is subsequently then reset by subtracting these converged error estimates from the LDS navigator, thereby improving the navigation solution, a described below.

Figure 12:
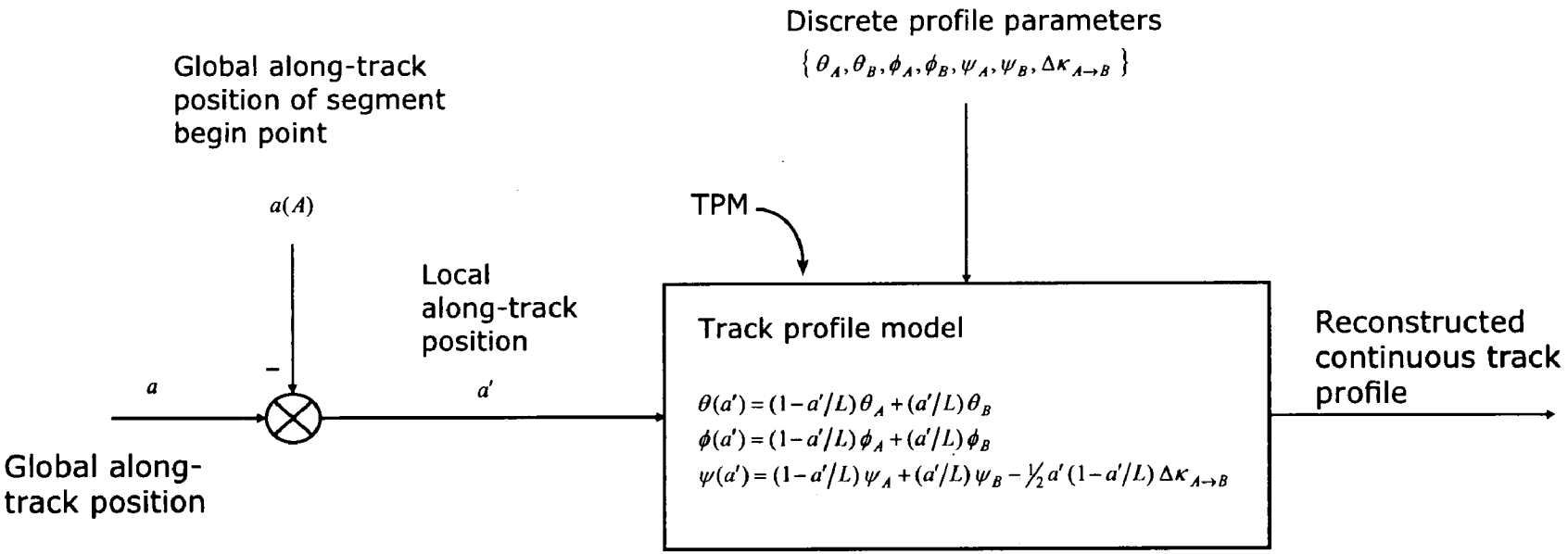
FIG. 12 is a block diagram illustrating how track geometry is reconstructed as a continuous function of along-track position using a stored or downloaeded discrete set of parameters.

The location determining system 10 uses discrete profile parameters for track segments to reconstruct a continuous track profile in the general vicinity of the train. The track profile model and reconstruction process are shown in FIG. 12. The track profile model TPM comprises a set of parametric interpolation formulas for the profile angles of grade ($\theta$), super-elevation ($\phi$), and heading ($\psi$) as a continuous function of a local along-track position variable (a'). As depicted in FIG. 12, the track profile model is applicable to a stretch of (single) track of length L bounded by two points A and B. Upon reaching the track section begin point (A) and shifting the origin for track position to this point, the local along-track position a' then takes on values from zero to L. The discrete parameter set defines grade at each of the endpoints A and B as $\theta_A$ and $\theta_{B'}$ respectively. Super-elevation and heading are similarly addressed. The final term in the formula for heading includes the variable $\Delta\kappa_{A\rightarrow B'}$ which represents the change-of-curvature in heading from track point A to track point B. The profile model is designed to be commensurate with the layout and construction of railroad track into tangent, curve, and spiral sections: specifying $\psi_A=\psi_B$ and $\Delta\kappa_{A\rightarrow B}=0$ gives a tangent track section; specifying $\psi_A\neq Y_B$ and $\Delta\kappa_{A\rightarrow B}=0$ gives a constant curvature track section; and specifying $\psi_A\neq\psi_B$ and $\Delta\kappa A_{\rightarrow B}\neq 0$ gives a spiral (i.e. changing curvature) track section. Various parameters, including the track 'signature' profile in the vicinity of the train can be pre-stored in memory or downloaded-on-the-fly.

The inertial sensors send data during recurring 'gate' periods (about 200 Hz) to the FIFO message queue 78 and, substantially concurrently, the GPS/DGPS position fixes are likewise sent to the FIFO message queue 78 at the 1 PPS rate during the time that sufficient satellites are visible. Lastly, wheel tachometer 92 data is also sent to the FIFO message queue 78 at a 1 Hz rate (as clocked by the 1 PPS signal.)

In the description to follow, inertial sensors are used; however, similar components could be substituted, e.g., strapdown magnetometer, radar device, etc.

The LDS navigator solves for the locomotive's along-track position. Velocity of the locomotive body relative to Earth is denoted by the physical vector ($\overline{v}_{EB}$), which is governed by the differential equation $$p_R\overline{v}_{EB}=\overline{a}_{SF}+\overline{g}_P-(\overline{\omega}_{ER}+2\overline{\psi}_{IE})\times\overline{v}_{EB}$$

where $p_R$ indicates time-differentiation as seen from the rail frame. Other vectors shown are the specific force acceleration ($\overline{a}_{SF}$), plumb-bob gravity ($\overline{g}_P$), the angular rate of the rail frame relative to Earth ($\overline{\omega}_{ER}$), and the angular rate of Earth relative to inertial ground ($\overline{\omega}_{IE}$). Simplifications to the above equation are possible as several of the terms have minimal contribution. The LDS navigator computes incremental changes in the locomotive's position, i.e. position increments, at regular intervals by integrating accelerometer outputs. Accelerometers measure specific force acceleration directly in accelerometer coordinates ($\underline{a}_{SF}{}^A$), i.e. as resolved along the LDS sensitive axes as determined by production calibration procedures. Solving the motion equation in rail coordinates directly (i.e. solving for $\underline{v}_{EB}{}^R$) yields along-track velocity $$v^R_{EB_y}$$

as the vector y-component, but requires specific force acceleration be aligned with the rail frame ($\underline{a}_{SF}{}^R$) as described below. Once aligned, the differential equation is integrated once for velocity along the track, across the track laterally, and across the track vertically, then is integrated again for position along the track, and for cross-track displacements. The general motion equation above simplifies practically for most circumstances so that the baseline model gives velocity and position vectors resolved in the rail frame $$\dot{\underline{v}}=\begin{pmatrix}\dot{v}_x\\ \dot{v}_y\\ \dot{v}_z\end{pmatrix}=(\underline{a}^R_{SF}-\underline{\varepsilon})+\begin{pmatrix}\sin\phi\cos\theta\\ -\sin\theta\\ -\cos\phi\cos\theta\end{pmatrix}g+\begin{pmatrix}\dot{\psi}v_y\\ \\ \\ \end{pmatrix}$$

$$\dot{\underline{r}}=\begin{pmatrix}\dot{r}_x\\ \dot{r}_y\\ \dot{r}_z\end{pmatrix}=\underline{v}$$

The variable $\underline{\varepsilon}$ captures errors in the measurement/computation of $\underline{a}_{SF}{}^R$ due to accelerometer bias drift, scale factor error, and broadband noise, as well as any error in the alignment of the accelerometer axes with the rail frame (discussed further below). Digitizing each accelerometer's analog voltage output (via suitably chosen analog-to-digital (A/D) converters) inherently performs the first integration. The resulting digital samples represent vector velocity increments ($\Delta\underline{v}$) for each sampling interval. Each velocity increment is converted to physical units using the coefficients calibrated for each LDS during production and is naturally resolved along the set of LDS calibration reference axes. The component of velocity increment along the track centerline is computed via $\Delta\underline{v}^{fore\text{-}aft}=\underline{j}^R\cdot\Delta\underline{v}$. Vector $\underline{j}^R$ is known from the alignment of the LDS relative to the rail reference frame (the rail reference frame is aligned with the track centerline profile). These fore-aft velocity increments are digitally integrated to yield along-track position increments as measured by the accelerometers.

Aligning the specific force acceleration with the rail frame may be done by defining a rotation matrix that takes accelerometer (A) coordinates to rail (R) coordinates. This is defined by two successive rotations; firstly a rotation from accelerometer (A) coordinates to locomotive cab (C) coordinates (given by matrix $C_A{}^C$), followed by a rotation from cab (C) coordinates to rail (R) coordinates (given by matrix $C_C{}^R$). The overall rotation is given by the matrix multiplication $$C_A{}^R=C_C{}^RC_A{}^C$$

from which the rail-resolved specific force acceleration vector is computed $$\underline{a}_{SF}{}^R=C_A{}^R\overline{a}_{SF}{}^A$$

Rotation $C_A{}^C$ accounts for the static (i.e. constant) mounting misalignment between LDS production-calibrated sensitive axes and the locomotive's longitudinal, lateral, and vertical axes. Practical limitations to how accurately misalignment can be measured upon LDS installation give rise to unknown, but constant errors in $C_A^C$. Rotation $C_A^C$ accounts for transient cab sway and misalignment of curved track beneath the locomotive between each of its suspension pivot points, i.e. the locomotive subtends a chord between its pivot points when traversing curved track and is therefore not strictly aligned with the centerline profile of the curved track. The curved track misalignment may be solved for by geometry considerations, but the cab sway remains a small, random time-varying error.

As the LDS is rigidly mounted to the locomotive cab the specific force acceleration may also be aligned with the rail frame by solving a conventional strapdown matrix differential equation for the alignment between the two reference frames. The differential equation is given by $$\dot{C}_A^R = C_A^R(\underline{\omega}_{IA}^A\times) - (\underline{\omega}_{LR}^R\times)C_A^R$$

The angular rate of the rail (R) frame relative to inertial ground is well approximated by the angular rate of the rail (R) frame relative to the local tangent plane (L) reference, i.e., $\underline{\omega}_{LR}^R \approx \underline{\omega}_{IR}^R$. Components of the angular rate are given by $$\omega_{LR}^R = \begin{pmatrix} \dot{\theta} - \phi\dot{\psi} \\ \dot{\phi} - \theta\dot{\psi} \\ \dot{\psi} + \phi\dot{\theta} \end{pmatrix}$$

which are solved for using the track profile and current speed of the locomotive. As shown in FIG. 12, the profile derivatives are given by $$\dot{\theta} = \frac{(\theta_B - \theta_A)}{L} v_{EB_y}^R$$

$$\dot{\phi} = \frac{(\phi_B - \phi_A)}{L} v_{EB_y}^R$$

$$\dot{\psi} = \frac{(\psi_B - \psi_A + (a' - 1/2L)\Delta\kappa)}{L} v_{EB_y}^R$$

Examining these formulas show that error in along-track speed gives rise to alignment errors. The angular rate of the LDS relative to inertial ground and resolved along LDS sensitive axes is denoted $\underline{\omega}_{IA}^A$, and may be measured directly by rate gyros. A full compliment of (i.e. three mutually orthogonal) gyros may be used to provide a conventional strapdown alignment solution. Bias drift and scale factor variations inherent to gyro performance give rise to errors in alignment computed by this method. Although the errors are unknown they are typically well characterized by bench testing the hardware components. Alternately, a single gyro may be used to sense turn rate about the (nominal) vertical axis, while rates about the remaining two axes (vis-à-vis pitch and roll rates) are relatively negligible and are nulled (set to zero). Errors in this approximation manifest themselves as small errors in the alignment matrix as well.

Predictions of incoming exogenous measurement data are computed periodically by the corresponding model of such measured data based on one or more of the aforementioned navigation solutions or various weighted combinations thereof. These predictions are differenced with the actual measurement data as it becomes available to form discrete error sequences henceforth referred to generally as "measurement residuals," the character of such being, by definition, indicative of a certain level of consistency between exogenous data and navigation computations internal to the device. The track profile may or may not be required for the predictive computation; FIG. 11 depicts the case where it is not required. Typical measurements include, but are not limited to, those provided by D/GPS (e.g. position fix data, speed and course over ground data, etc.) and those provided by various wheel-mounted tachometers, namely, speed data or position increment data.

On receiving D/GPS position fix data, the navigator computes local-tangent-plane (L) coordinates $\bar{r}_{EB}^L(a')$ of the locomotive's position by integrating the unit vector ($\underline{u}$) directed along the track centerline profile from the segment begin point coordinates $\underline{r}_A^L$ to the along-track offset (d) into the currently occupied track segment. The integral is given by $$\underline{r}_{EB}^L(\alpha') = \underline{r}_A^L + \int_0^{\alpha'} \underline{u}(\psi(\tau), \theta(\tau))d\tau$$

where the unit direction vector is defined in terms of heading and grade profile angles as $$\underline{u}(\psi, \theta) = \begin{pmatrix} -\cos\theta\sin\psi \\ \cos\theta\cos\psi \\ \sin\theta \end{pmatrix}$$

Comparing these predicted coordinates to those measured by D/GPS position fix data as shown in FIG. 8 forms the position fix measurement residual (understood to occur at time $t_k$ though not explicitly written for the sake of brevity) given by $$z_1 = (\underline{r}_{D/GPS}^L - \underline{\kappa}) - \left(\underline{r}_A^L + \int_0^{\alpha'} \underline{u}(\psi, \theta)d\tau\right)$$

The measurement residual includes errors in the navigator's prediction as well as any errors present in the D/GPS measurement itself. Errors in the position fix data may be modeled by the variable $\underline{\kappa}$ then removed as shown (its value is simply set to zero if measurement errors are not modeled). FIG. 8 shows measurement residuals formed for other preferred exogenous data sources utilized. This includes D/GPS speed-over-ground and course-over-ground data, and tachometer-derived position increments.

Similar to the above, the measurement residual for D/GPS speed-over-ground (SOG) data is given by $$z_2 = (v_{SOG} - \upsilon) - |v_y|$$

where the variable $\upsilon$ may be used to account for errors in SOG data.

The LDS receives tachometer data over the locomotive network as a number of pulses (n) counted over a sampling interval (T). The number of pulses is multiplied by a distance-per-pulse variable ($D_P$) maintained by the LDS navigator. As tachometer data is generally unsigned, this produces a measure of the gross change in along-track position. The measurement residual for individual tachometer-derived position increments is given by $$z_3 = (nD_P - \lambda) - \int_t^{t+T} \left| v_y \right| d\tau$$

The variable λ may be used to model errors in the incoming tachometer data due to erroneous distance-per-pulse value, broadband noise, and wheel slip, wheel slide, or wheel creep. The LDS may similarly use D/GPS position fix data to compute position increments. A displacement vector (δ) from the last accepted position fix ($\underline{r}_j$) to the incoming position fix ($\underline{r}_{j+1}$) is defined by $\underline{\partial}=\underline{r}_{j+1}-\underline{r}_j$. Computing the dot product between this displacement vector and the unit direction track profile vector ($\underline{u}_j$) gives the along-tack displacement increment (Δ) via successive D/GPS position fix data, i.e. $\Delta=\underline{u}_j$.

As shown in FIG. 8, the D/GPS position fix block 300 is subject to error removal at point 302 and then differenced with the inertial (i.e., strapdown) position vector 304 at point 306 to provided an observed difference. In a similar manner, the D/GPS velocity fix block 301 is again subject to error removal at point 308 and then differenced with the inertial (i.e., strapdown) velocity vector 310 at point 312 to provided a corresponding observed difference. Similarly, the locomotive longitudinal distance value of block 314 is differenced with the track profile-based along-track distance value at point 316.

The observed difference values of FIG. 8 are provided to FIG. 9 for combination with other observed differences. More specifically and as shown in FIG. 9, tachometer wheel radius (which may also include a scale factor) is differenced with wheel radius error information in block 328 at point 330 and, in turn, multiplied with the tachometer wheel rotation rate in block 332 at point 334 with the output differenced with the averaged along track speed in block 336 at point 338 to provide the corresponding observed difference.

The D/GPS speed-over-ground measurement in block 340 is differenced with the averaged along-track speed at point 344 to provide an observed difference. Lastly and in a similar manner, the track profile parameters of block 346 are combined with the along track distance of block 348 to compute the locomotive orientation relative to Earth in function block 350 with that value differenced with the inertially derived alignment matrix in block 353 at point 354 to provide the corresponding observed difference.

On receiving the inputted track profile and one or more navigation solutions or various weighted combinations thereof, the model of physical constraints computes variables defined specifically to quantify the level of agreement between the navigation solutions and kinematic relations known to govern the motion of a locomotive on a railroad track. The variables are predictive in nature and are defined in a manner such that when zero-valued the physical constraints are satisfied. Values of these variables are equivalently referred to herein as "constraint values." The predicted constraint values are differenced with the desired zero-values (referred to as "null pseudo-measurements") at high rate to form discrete error sequences henceforth referred to generally as "constraint violations," which in lieu of the above discussion are seen to equal, mathematically, the negative of the constraint values. Examples of variables so defined include, but are not limited to those which quantify the conflicting of prior knowledge that movement of the locomotive is directed along its longitudinal axis primarily (except for random, zero-mean lateral vibration), and also is aligned with the track profile of the occupied track. Such considerations have not been given explicitly in the present context elsewhere.

FIG. 9 shows the constraint residuals formed by comparing predicted constraint violations with known zero or null values. Constraint residuals, respectively, for lateral and vertical displacements relative to the rail frame are thus given by $$z_4=(0-\mu)-r_x$$

$$z_5=0-r_z$$

where the variable μ may be used to account for small transient lateral deflections due to cab sway or curved track misalignment beneath the locomotive.

Non-exogenous data also with error mechanisms complimentary to the LDS navigator are used to further assist in correcting navigator errors. The non-exogenous data sources comprise kinematics relations known to govern the motion of a locomotive, and the a priori knowledge that kinematics-aligned and strapdown-aligned specific force acceleration will yield the same navigation solution when alignment errors are corrected.

The two alignment solutions described above are seen to have different error mechanisms. In the first (kinematics-based) approach the constant portion of the errors are due to inaccurate mount installation alignment, while the transient portion is due to cab sway (nominally a zero-mean random process, with practical limits of just a few degrees of deflection). In the second (strapdown) approach errors are due primarily to gyro bias drift. Errors inherent to the strapdown alignment have frequency content below that imparted by cab sway for the kinematics alignment, yet above that of the steady (i.e. zero frequency) portion due to mount installation misalignment. Separating errors in the frequency domain like this is one way of establishing the complimentary nature of these error mechanisms. By complimentary is meant that when compared by appropriate means, one alignment value may be used to correct the other, and vice versa. The LDS estimator discussed further below is the appropriate means alluded to here. Note that, as mentioned in the Summary section, if these errors are corrected for, both alignment computations produce the same specific force acceleration resolved to rail coordinates, and ultimately the same navigation solution for along-track position, speed, etc.

In the context of computing velocity and position vectors, for example, the strapdown navigation solution is subject to low frequency bias and random walk errors typical of inertial sensors. Such errors grow in an unbounded manner upon integrating accelerometer and gyro output signals to obtain velocity and position, i.e., the computation has poor long-term stability. Conventionally, these long-term errors are corrected for by blending with (e.g., in a Kalman filter or similar Bayesian estimator) D/GPS data which possess comparatively excellent long-term stability. Also, and conversely, the navigator solution possesses good short-term stability, as the integration process tends to smooth high-frequency sensor errors (which are usually attenuated significantly by low-pass filtering), while D/GPS data has comparatively poor short-term stability due to multi-path effects, broadband noise, etc.

The present invention uses the above approach, but due to the inevitable loss of the D/GPS data, also seeks additional complimentary data sources that can be blended in a similar manner.

These additional data sources are provided by the projection and subsequent integration of the velocity vector along both the track profile (reference axes aligned with the track centerline and moving with the locomotive), and Locomotive-fixed reference axes. The term geo-reconciliation is used herein because both of these data and subsequent calculations involve various geometric parameters, e.g., the orientation of the reference axes aligned with the tack profile is defined in terms of latitude, longitude, grade, superelevation, and heading, and the orientation of locomotive-fixed reference axes is given by a constant mounting misalignment matrix with respect to the device.

As these data sources are analytic in nature, their availability for blending is essentially continuous, in contrast, for example, with GPS position fix data where typically only a single data point is available each second and only when sufficient satellites are visible to compute a fix.

The output of the scale factor/units conversion function block 160 is subject to the removal of known or estimated sensor errors/biases at point 176 with this error-corrected value provided to the functional block 178 that effects a digital integration of the nonlinear motion equations associated with strapdown navigation systems using information from an appropriately selected gravity and spheroid model, such as the WGS-84 dataset.

The output of the functional block 178 is periodically gated at 182 and, thereafter, various estimated velocity, position, and alignment errors are removed at point 184; the output being the error-compensated strapdown navigation solution for the various inputs.

Figure 6:
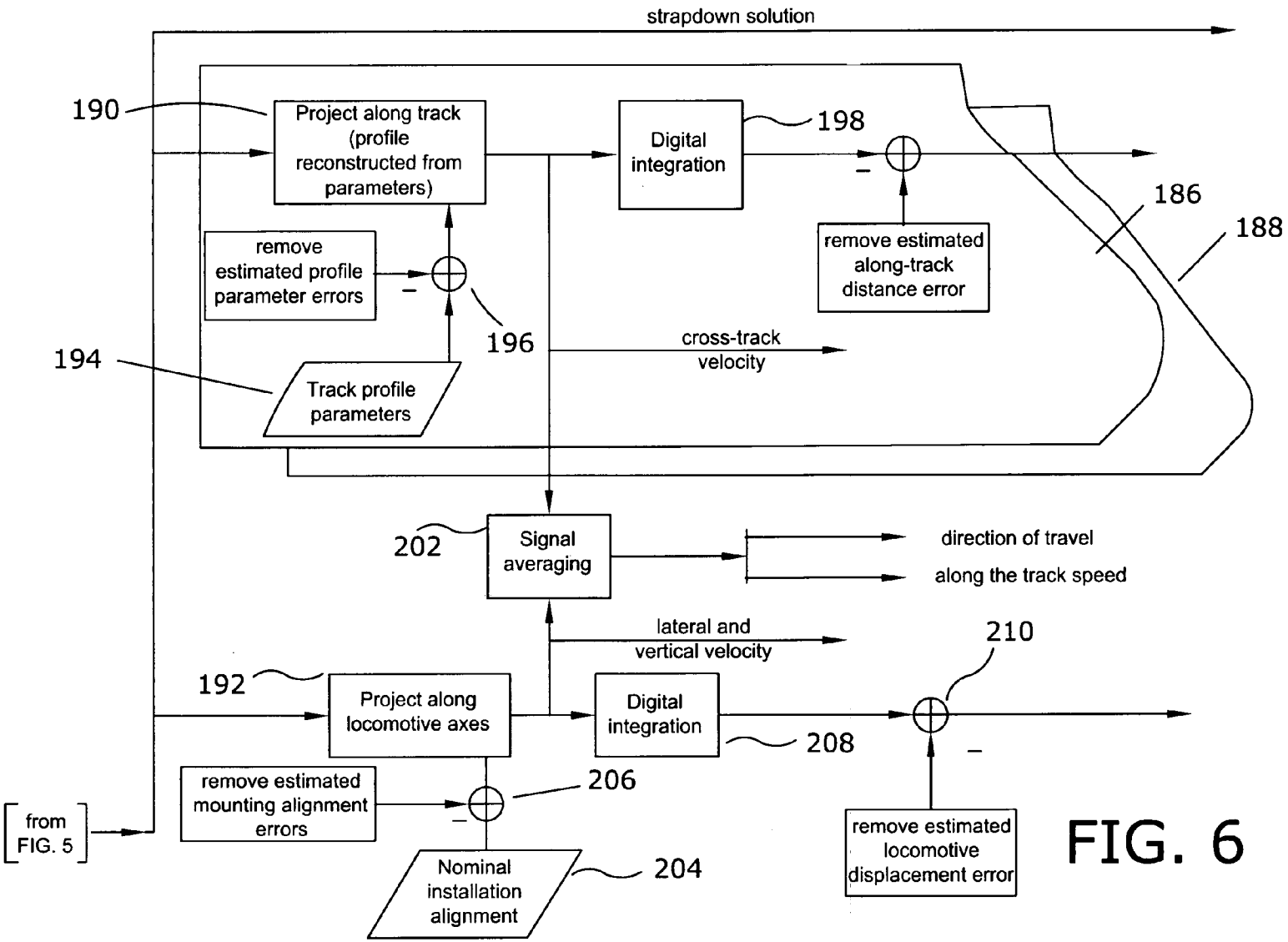

As shown in FIG. 6, the velocity vector solution from FIG. 5 is provided to a track projection block 190 (of the process 186) and to a project along the locomotive axis block 192. The projection block 190 also receives an input from the track profile functional block 194 from which estimated profile parameters errors are removed at point 196. The output of the projection block 190 (representative of the along-track and cross-track velocities) is subject to an integration in block 198 to, in turn, output along-track and cross-track displacements. Estimated along-track distance errors are removed from the output of block 198 at point 200 such that process 186 outputs the error-corrected along-track distance, cross-track displacements, and cross-track velocities from the main track solution.

As shown in the lower part of FIG. 6, the along-track and cross-track velocities from functional block 190 are output to a signal averaging block 202 which also accepts the outputs of functional block 192 to output direction of travel and along-track speed.

The functional block 192 also accepts the nominal installation alignment values from block 204 and estimated mounting alignment errors are removed at point 206. The output of the functional block 192 is subject to integration at 208 to output the locomotive longitudinal distance and lateral displacement with corresponding errors removed at 210.

Summing junctions 316, 320, 326, and 354 effect geo-reconciliation when processed by the Kalman filter. Junctions 320 and 324 also effect the physical constraints on the locomotive's motion. The cross-track velocities of block 318 are differenced with a null value at point 320, and the lateral and vertical velocity of block 322 are differenced with a null value at point 324 to provide corresponding observed differences. It is noted that differencing with a null value is justified in the case of function blocks 314, 318, and 322 since the average value is at or near zero. These "pseudo-measurements" are used to effect the physical constraints of the locomotive's motion.

All of the abovementioned measurement residuals (corresponding to exogenous and non-exogenous data sources) are input to the optimal estimator module. Internal to the estimator is a process that models errors in the navigation solutions, errors in measurement devices, and a model of the incoming observed differences in terms of these errors, as mentioned previously. The optimal estimator module takes as inputs each of the abovementioned track profile, navigation solutions, inertial sensor data, measurement residuals, and constraint violations. Internal to the estimator is a process that models errors in the navigation solutions, including misalignments required to bring navigation solutions to a common frame of reference as mentioned above. The process model is generally a function of the track profile, the navigation solutions, and the inertial sensor data. Also internal to the estimator are a model of incoming measurement residuals and a model of constraint violations, both of which are generally formulated in terms of the track profile and modeled navigation errors. These are used to predict values of incoming measurement residuals and constraint violations. The set of predicted values are subsequently differenced with the actual corresponding input values to form what is referred to henceforth as "filter residuals." The computation of the estimator is arranged such that by feeding the correct and unique navigation errors back to the navigation module, upon which they are removed from the navigation solution, the filter residuals be driven to zero in an appropriate average or mean-square sense, thereby confirming the navigation solutions well-predict the exogenous measurement data, and that the physical constraints imposed are also satisfied. A Kalman filter (or other Bayesian estimator) is a suitable means of automating such computations.

Continuing the example baseline navigator, its corresponding dynamic process error model may be given by $$\delta\dot{\underline{v}} = -\delta\underline{\varepsilon} + \begin{pmatrix} \sin\phi\cos\theta \\ -\sin\theta \\ -\cos\phi\cos\theta \end{pmatrix}\delta g + \begin{pmatrix} \dot{\psi}\delta v_y + v_y\delta\dot{\psi} \\ \\ \\ \end{pmatrix}$$

$$\delta\dot{\underline{r}} = \delta\underline{v}$$

$$\delta\dot{\underline{\varepsilon}} = \ldots$$

$$\delta\dot{\underline{k}} = \ldots$$

$$\delta\dot{v} = \ldots$$

$$\delta\dot{\lambda} = \ldots$$

$$\delta\dot{\mu} = \ldots$$

Figure 10:
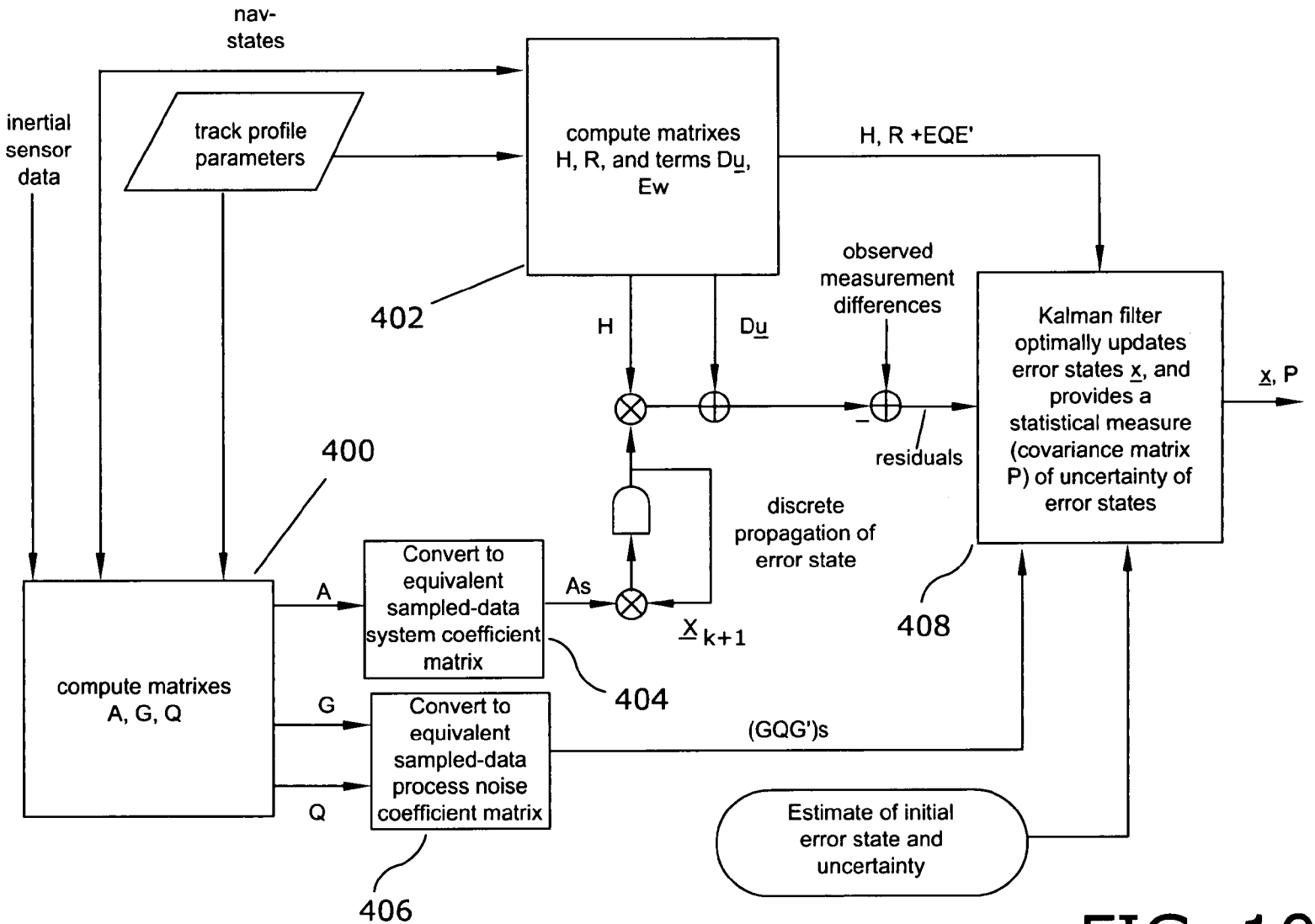
FIG. 10 is an error model for the track occupancy at a turnout solution.

For brevity, explicit models for the error variables $\delta\underline{\varepsilon}$, $\delta\underline{K}$ etc., are omitted as they vary somewhat depending on selected hardware, and the method described does not depend on any particular representation thereof. The δ notation is used consistently to define error variables as the difference between the navigator's computation and the true (but unknown) values, i.e.

$$\delta\underline{v} = \underline{v}_{NAV} - \underline{v}_{TRUE} = \hat{\underline{v}} - \underline{v}$$

$$\delta\underline{r} = \underline{r}_{NAV} - \underline{r}_{TRUE} = \hat{\underline{r}} - \underline{r}$$

$$\delta\underline{\varepsilon} = \underline{\varepsilon}_{NAV} - \underline{\varepsilon}_{TRUE} = \hat{\underline{\varepsilon}} - \underline{\varepsilon}$$

and so on. Throughout, the hat ^ symbol is used above variables to denote estimated values. FIG. 10 illustrates the various parameter matrices used to synthesize the error model as required by the Kalman filter and for the approach to a turnout solution including functional block 400 that computes a continuous-time error model system coefficient matrix A, modeling error/process noise influence matrix G, and model truncation/process noise covariance matrix Q and functional block 402 that computes an output sensitivity matrix H, direct transmission term Du, model truncation/process noise influence term Ew, and measurement uncertainty matrix R.

The error model states for functional block 400 include strapdown-computed position errors, strapdown-computed velocity errors, and strapdown-computed alignment errors, the locomotive longitudinal distance error, the along-track distance error, the inertial sensor bias and scale factor errors, the locomotive cab mount installation misalignment, the locomotive cab sway, the GPS/DGPS position and velocity fix errors, the tachometer-based distance-per-pulse scale factor error, and the track profile longitude, latitude, grade, superelevation, and heading parameter errors. The process noise statistics for function block 400 effectively characterize inertial sensor bias and scale factor stability, inertial sensor broadband noise, track profile parameter error influence on locomotive longitudinal distance error calculation, track profile parameter error influence on along-track distance error calculation, cab mount vibration, cab sway and effects due to neglected suspension characteristics and unmodeled motions/misalignments, GPS/DGPS position and velocity fix drift characteristics, and tachometer-based distance-per-pulse scale factor degradation.

The estimator's model of the measurement residuals sequence is given for the baseline model in terms of the error variables via $$\delta z_1 = -\delta \underline{\kappa} - \frac{\partial}{\partial a'}\left(\int_0^{a'} \underline{u}(\psi, \theta)d\tau\right)\delta r_y$$

$$\delta z_2 = -\delta \upsilon - \delta v_y$$

$$\delta z_3 = -\delta \lambda - \delta v_y$$

$$\delta z_4 = -\delta \mu - \delta r_x$$

$$\delta z_5 = -\delta r_z$$

The measurement errors modeled in function block 402 include the difference between GPS/DGPS position and velocity vectors and strapdown position and velocity vectors, respectively, the difference between track profile-based along-track distance and loco-longitudinal axis-based along-track distance, the deviation of cross-track velocity from null, the deviation of lateral velocity from null, the difference between tachometer-based speed measurement and computed average along-track speed, the difference between GPS/DGPS speed-over-ground measurement and computed along-track speed, and the difference between strapdown navigation and track profile-based alignment matrices.

The measurement error statistics for the function block 402 effectively characterizes D/GPS receiver position and velocity fix uncertainties, GPS/DGPS speed-over-ground uncertainty, tachometer-based distance-per-pulse resolution and noise, the tolerance on differences between track profile-based along-track distance and loco-longitudinal axis-based along-track distance, acceptable departure of cross-track velocity from null, acceptable departure of lateral and vertical velocity from null, and the difference between strapdown navigation and track profile-based alignment matrices.

Regardless of modeling considerations for the error variables not explicitly shown above, the resulting dynamic process error model generally fits the standard form commonplace in the open literature $$\dot{\underline{x}}(t)=A(t)\underline{x}(t)+B(t)\underline{u}(t)+G(t)\underline{w}(t)$$

$$\underline{y}(t_k)=H(t_k)\underline{x}(t_k)+\underline{v}(t_k)$$

On converting to discrete-time (i.e. digitized) equivalent representation, the standard form is written as a propagation from time $t_{k-1}$ to time $t_k$ as $$\underline{x}_k=A_k\underline{x}_{k-1}+B_k\underline{u}_{k-1}+\underline{w}_{k-1}$$

$$\underline{y}_k=H_k\underline{x}_k+\underline{v}_k$$

For typical track configurations the coefficient matrices A, B, and H are nearly constant over many propagation stages, and the notation is suppressed. The time-invariant form reflecting this is written as $$\underline{x}_k=A\underline{x}_{k-1}+B\underline{u}_{k-1}+\underline{w}_{k-1}$$

$$\underline{y}_k=H\underline{x}_k+\underline{v}_k$$

The turnout detection methodology described below does not depend on this time-invariance, though this form is used henceforth for brevity.

The output of the function block 400 is provided to converting blocks 404 and 406 with the converted output of block 406 provided to the optimal (Kalman) estimator 408 and the output of the block 404 processed with that of the block 402 prior to inputting into the optimal estimator 408.

Implicit in the discussion above is the assumption that the track profile input to the navigation module, the physical constraint module, and the estimator module, accurately represents the track occupied by the locomotive, from which movement upon results in the data generated by the inertial measurement or dead reckoning unit. This condition is relied upon for the existence of a unique (i.e. mathematically observable) set of navigation errors that simultaneously drives the filter residuals to zero, i.e. there exists a unique set of errors that can be computed by the estimator while operating in the feedback arrangement with the navigator as shown in FIG. 11, accepting as inputs the measurement residuals and constraint violations as shown, and driving filter residuals to zero value. Only when this condition exists is there balance or agreement between what the inertial measurement unit senses, what the navigation module predicts, what the exogenous measurements indicate, what the physical constraints impose, what the estimator computes as errors, and what the estimator outputs as filter residuals. Simultaneously, and because of this unique balance, it is possible to solve deterministically for the effects on the filter residuals due to erroneous track profile inputs. This provides a mechanism to solve the track discrimination problem. Namely, a second (computational) instance of FIG. 11 is begun just prior to traversing a turnout (but sharing with the first instance the common inertial measurement unit, or equivalent, and exogenous measurement data). This second instance is supplied with the discrete track profile parameters for the alternate track beginning at the point of divergence. The filter residuals for both instances are monitored as the locomotive traverses the turnout, upon which in a timely manner the filter residuals produced by the estimator given the incorrect track profile deviate in a known deterministic manner from their aforementioned zero-mean characteristics. Stated differently, the filter residuals change from being zero-mean stochastic sequences, to the same but with a deterministic "detection signal" superimposed. Upon observing this, it is concluded unambiguously which computational instance corresponds to the correct track profile, and equivalently which track the locomotive occupies. The track detection problem is thus solved, whence the computational instance corresponding to the incorrect track is terminated.

The method for turnout detection is best illustrated by an example with attendant simplifying assumptions, though the method is not restricted to these assumptions.

Figure 13:
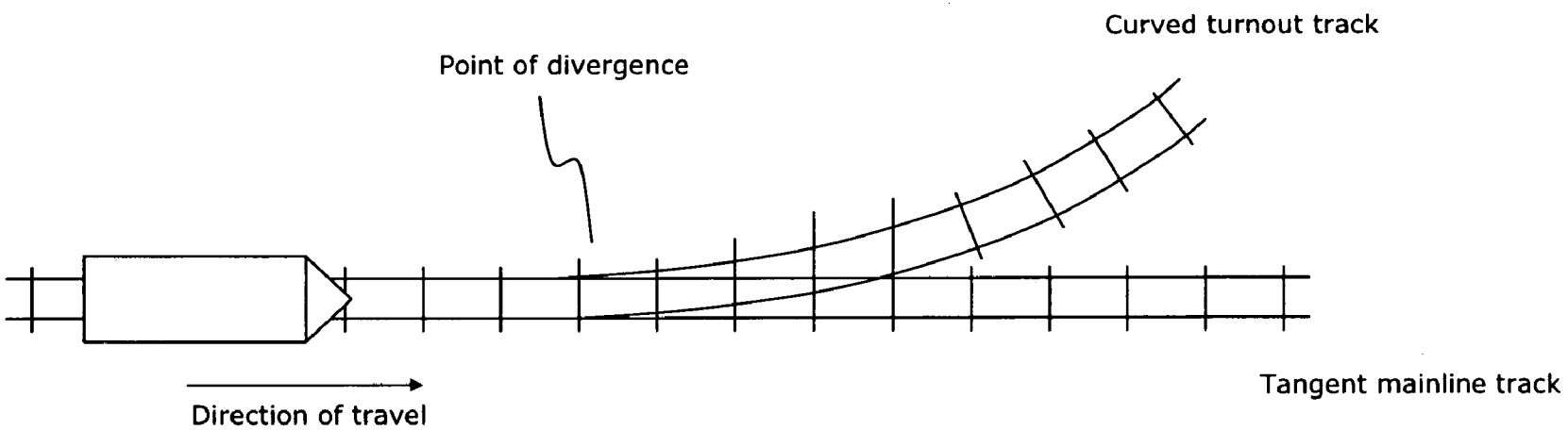
FIG. 13 is a schematic diagram illustrating a locomotive turning from a mainline track onto a curved track at a point of divergence.
Figure 14:
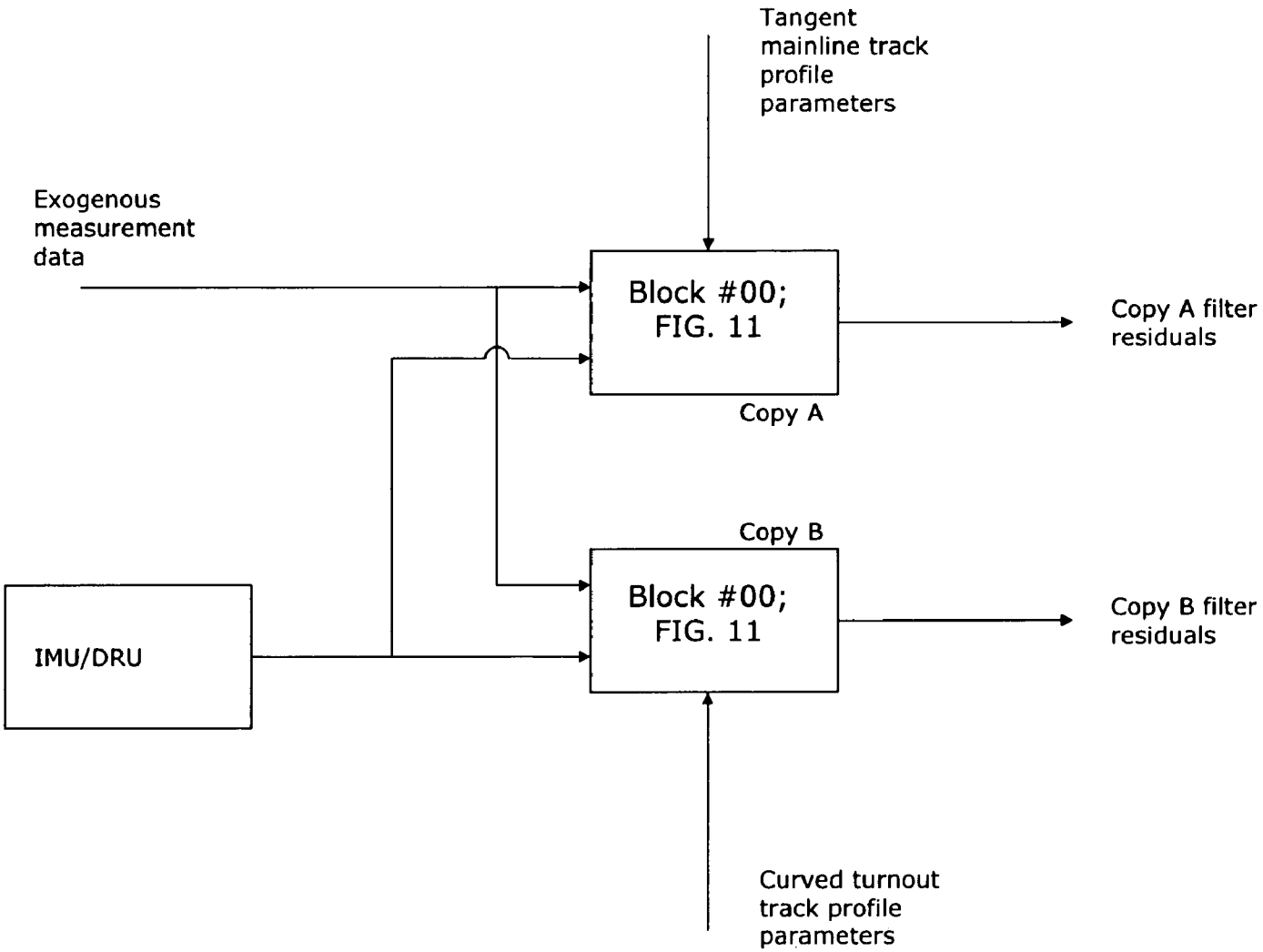
FIG. 14 is a block diagram illustrating the manner in which a processing block of FIG. 11 accepts inertial measurement data and exogenous data for a first and second computational instance.

Assume a locomotive is moving at constant speed on flat (i.e. zero grade and super-elevation) and tangent (i.e. zero curvature) mainline track approaching a flat turnout (also zero grade and super-elevation, but non-zero curvature) as depicted in FIG. 13. The second instance or copy "B" of block #00 of FIG. 11 is begun prior to reaching the point of divergence and is an exact replicate of the first instance or copy "A", i.e. copy B is supplied the track profile parameters for the tangent mainline. The IMU/DRU and exogenous measurement data feed into both copies as shown in FIG. 14, thus both navigators and both estimators compute identical solutions, and both sets of filter residuals produced are the same.

On reaching the point of divergence, or switch point, copy B is supplied with the track profile parameters corresponding to the curved turnout track, while copy A continues on with the tangent mainline track profile parameters. As the locomotive departs the mainline and continues on the turnout track, copy A carries on with its navigator module, exogenous measurement module, physical constraint module, and estimator module all basing their computations on the incorrect underlying equations, whereas computations for copy B are all based on the correct underlying equations.

Specifically, copy B's estimator implements the correct error model in its Kalman filter. Consider a few variables of the error model now. Given the assumption of flat track, the velocity error of the baseline error model given previously reduces to $$\delta\dot{\underline{v}} = -\delta\underline{\varepsilon} + \begin{pmatrix} \\ \\ -1 \end{pmatrix}\delta g + \begin{pmatrix} \dot{\psi}\,\delta v_y + v_y\,\delta\dot{\psi} \\ \\ \end{pmatrix}$$

A turn rate sensor may be utilized to measure the rate of change in heading, $\dot{\psi}$. Errors associated with this measurement, e.g. gyro bias drift, scale factor error, broadband noise, etc., would also be modeled as the general error variable for heading rate, $\delta\dot{\psi}$.

Alternately, we assume no turn rate-measuring device is used. For this case the heading rate is computed given the curvature of the turnout track (c) and the speed of the locomotive over it, i.e.

$$\dot{\psi} = c v_y$$

The equation for velocity error then becomes $$\delta\dot{\underline{v}} = -\delta\underline{\varepsilon} + \begin{pmatrix} \\ \\ -1 \end{pmatrix}\delta g + \begin{pmatrix} 2\,c\,v_y \\ \\ \end{pmatrix}\delta v_y$$

The D/GPS position fix measurement residual model likewise simplifies for the case of flat track as shown below, where the integral term is expressed in series form in terms of the difference in heading between the curved track endpoint headings $\Delta_\psi = \psi_B - \psi_A$.

$$\delta z_1 = -\delta\underline{K} - \begin{pmatrix} -\sin\psi_A\left(1 - \frac{1}{6}\Delta_\psi^2 + \frac{1}{120}\Delta_\psi^4 - \cdots\right) - \\ \cos\psi_A\left(\frac{1}{2}\Delta_\psi - \frac{1}{24}\Delta_\psi^3 + \cdots\right) \\ \cos\psi_A\left(1 - \frac{1}{6}\Delta_\psi^2 + \frac{1}{120}\Delta_\psi^4 - \cdots\right) - \\ \sin\psi_A\left(\frac{1}{2}\Delta_\psi - \frac{1}{24}\Delta_\psi^3 + \cdots\right) \\ \\ \end{pmatrix}\delta r_y$$

The example terms worked out above fold into the standard form for copy B's error model, which is henceforth designated with the subscript "C" denoting curved track $$\underline{x}_{C_k}^- = A_C\underline{x}_{C_{k-1}}^+ + B_C\underline{u}_{k-} + \underline{w}_{k-1}$$

$$\underline{y}_{C_k} = H_C\underline{x}_{C_k} + \underline{v}_k$$

Copy B's Kalman gain matrix $K_C$ is computed based on this model, and as measurement residuals and constraint violations are received ($\underline{y}_{C_k}$), it then updates its estimates (i.e. it conditions its estimates of navigation errors based on the newly received data) of copy B's navigation errors via $$\hat{\underline{x}}_{C_k}^+ = \hat{\underline{x}}_{C_k} + K_C\underline{r}_{C_k}$$

where $\underline{r}$ is the filter residual defined as the difference between incoming measurement residuals and constraint violations and their corresponding values as predicted by the error model prior to conditioning with the latest data, i.e.

$$\begin{aligned} \underline{r}_{C_k} &= \underline{y}_{C_k} - H_C\hat{\underline{x}}_{C_k}^- \\ &= H_C\left(\underline{x}_{C_k} - \hat{\underline{x}}_{C_k}^-\right) + \underline{v}_k \end{aligned}$$

Because copy B is supplied with the correct underlying model, the Kalman filter is unbiased and the mean of the filter residual conditioned upon the set of all prior data $\{\underline{y}_C\}$ is zero (i.e. the conditional mean of the residual is zero). This property is well established in the open literature and is written here using the expectation operator (E) as $$E_{\{\underline{y}_C\}}\{\underline{r}_{C_k}\} = \underline{0}$$

The same discussion above is repeated for copy A now, where its standard model error form is adorned with a "T" to indicate tangent mainline track profile parameters are used, and to distinguish it from that for the curved turnout track $$\underline{x}_{T_k}^- = A_T\underline{x}_{T_{k-1}}^+ + B_T\underline{u}_{k-1} + \underline{w}_{k-1}$$

$$\underline{y}_{T_k} = H_T\underline{x}_{T_k} + \underline{v}_k$$

Because copy A is supplied with track profile parameters for the continuing tangent mainline track (the track not taken beyond the point of divergence though), its model error coefficient matrices A and H differ from that of copy B's.

Specifically, for copy A the velocity error equation doesn't include the effect of track curvature given by the term $$\begin{pmatrix} 2cv_y \\ \\ \end{pmatrix}\delta v_y$$

Likewise, there are errors unaccounted for in the term $\delta\underline{\epsilon}$ stemming from copy A's belief that since we're on tangent track the specific force acceleration is already aligned with the rail frame. These and other modeling errors are captured by the mismodeling coefficient matrix defined as $$A_\Delta = A_T - A_C$$

Copy B's D/GPS position fix measurement residual model likewise neglects track curvature, believing the locomotive is still traveling on tangent mainline track after it has passed the point of divergence, and so reduces to $$\delta z_1 = -\delta K - \begin{pmatrix} -\sin\psi_A \\ \cos\psi_A \end{pmatrix}\delta r_y$$

These and other measurement residual and constraint violation modeling errors are captured by the mismodeling coefficient matrix defined as $$H_\Delta = H_T - H_C$$

Copy A's Kalman gain matrix $K_T$ is computed based on the invalid underlying model. Despite this, the estimator computes away as measurement residuals and constraint violations are received ($\underline{y}_{T_k}$), updating its estimates of copy A's navigation errors via $$\hat{\underline{x}}_{T_k}^{+} = \hat{\underline{x}}_{T_k}^{-} + K_T \underline{r}_{T_k}$$

where $\underline{r}$ is the filter residual, i.e. the difference between incoming measurement residuals and constraint violations and their corresponding values as predicted by copy A's invalid error model prior to conditioning with the latest data, i.e.

$$\underline{r}_{T_k} = \underline{y}_{T_k} - H_T \hat{\underline{x}}_{T_k}^{-} = H_T(\underline{x}_{T_k} - \hat{\underline{x}}_{T_k}^{-}) + \underline{v}_k = -H_T \underline{e}_{T_k}^{-} + \underline{v}_k$$

where the difference between the estimated navigation errors and their true but unknown values before the update has been defined as $$\underline{e}_{T_k}^{-} = \hat{\underline{x}}_{T_k}^{-} - \underline{x}_{T_k}$$

This same difference is defined after the measurement update by $$\underline{e}_{T_k}^{+} = \hat{\underline{x}}_{T_k}^{+} - \underline{x}_{T_k}$$

In contrast to copy A, for this case, since copy B is supplied with an invalid underlying model the Kalman filter is not unbiased, and the conditional mean of the residual is governed in terms of its mismodeling matrices by $$E_{\{\underline{x}_T\}}\{\underline{r}_{T_k}\} = -H_C A_C E_{\{\underline{x}_T\}}\{\underline{e}_{T_{k-1}}^{+}\} - (H_C A_\Delta + H_\Delta A_C + H_\Delta A_\Delta)\hat{\underline{x}}_{T_{k-1}}^{+}$$

This equation is seen to be deterministic, i.e. none of the quantities on its right-hand side are random. The recursion required by the above equation for the difference between the estimated navigation errors and their true but unknown counterparts (after the measurement update) is given by the equation (also deterministic)

$$E_{\{\underline{x}_T\}}\{\underline{e}_{T_k}^{+}\} = -(I - K_T H_C)A_C E_{\{\underline{x}_T\}}\{\underline{e}_{T_{k-1}}^{+}\} - ((I - K_T H_C)A_\Delta - K_T H_\Delta A_T)\hat{\underline{x}}_{T_{k-1}}^{+} + K_T H_\Delta B_T \underline{u}_{k-1}$$

The turnout detection problem is solved by noting the filter residuals generated online by the estimator module for copy A evolve as governed by the systematic conditional mean sequence defined above, superimposed on the otherwise broadband noise component exhibited by Kalman filters generally.

Distinguishing features of this turnout detection method include the fact that: 1. it applies even in the absence of a gyro or other turn rate sensor as shown in the example; 2. the detection signal is deterministically computed; 3. and is computed hand-in-hand with the ongoing processing typical of the navigator and Kalman filter (i.e. it doesn't require storing a batch of data from which statistical measures are later drawn); 4. is multi-dimensional (i.e. the residual is a vector of variables) thus providing multiple detection signals from which to base the turnout detection; 5. navigation solutions always position the locomotive on the track (i.e. beyond the point of divergence the navigation solutions are still constrained to the mainline or turnout track and not allowed to wander somewhere between, in hopes of later detecting a significant overlay of points on one versus the other).

The process of FIG. 6 uses the strapdown velocity solution of FIG. 5 and includes two additional principal processes, the mainline track 186/turnout track 188 and the locomotive projection solution.

Fault detection logic is used to correctly maintain track occupancy at branch points; a solution is computed along each of the two diverging tracks at a turnout. Forcing the solution to propagate along the incorrect track subsequently yields step and ramp changes in estimated error mechanisms. These signals are strong enough and sufficiently diverse to make the track-occupancy- at-diverging-tracks decisions with confidence and in a timely manner.

Figure 7:
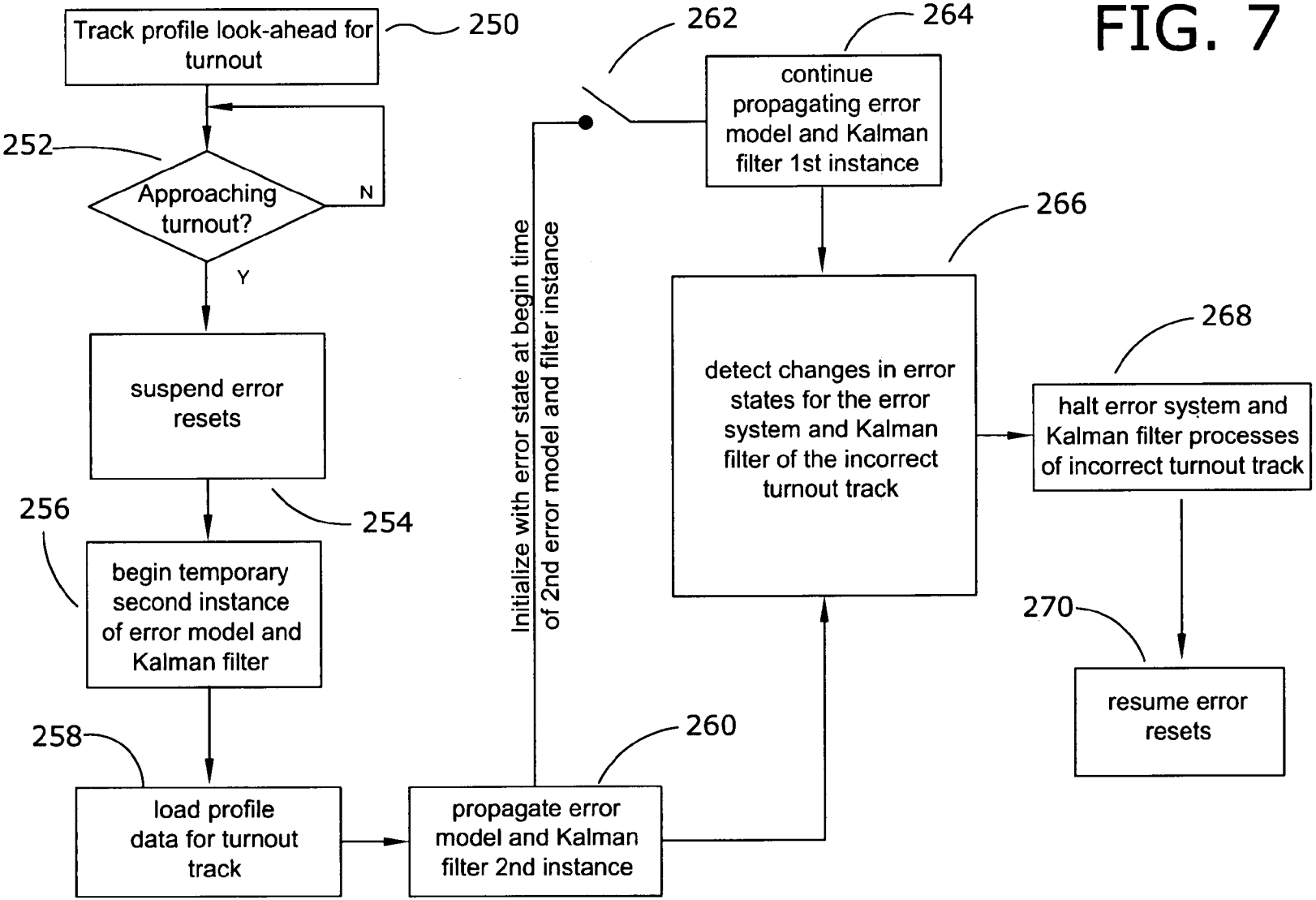
FIG. 7 is an overall process flow diagram of the solution of track occupancy at a turnout.

The turnout track solution process 188 is similarly configured. The location determination system 10 addresses the turn-out track determination problem, as shown in FIGS. 7, 8, and 9, by using fault detection concepts to compute solutions for each of the two diverging tracks at a turnout or branch point. The solution forced to propagate along the incorrect track eventually yields step- and ramp-wise changes in estimated error states. The presence of these changes drives the correct solution of the track-occupancy-at-diverging-tracks problem quickly and with a high degree of confidence.

As shown in the overall process diagram of FIG. 7, the impending turnout is determined by a look-ahead functional block 250. A query is presented at decision point 252 as to the whether or not a turnout is being approached, and, if no, the process flow loops. If a turnout is being approached a "second instance" optimal estimator is initiated at block 256 and the turnout track data profile is loaded at block 258. Thereafter, the second instance error propagation proceeds in functional block 260 after initialization via initialization event command 262. Functional blocks 264 and 266 effect continuing processes while checking for the presence of changes in estimated sensor error mechanisms. The presence of these changes indicates a 'wrong track' outcome (thus determining the correct track). Thereafter, the filter process pertaining to the unoccupied track is halted at functional block 268 and the filter process pertaining to the occupied track continues.

Figure 4:
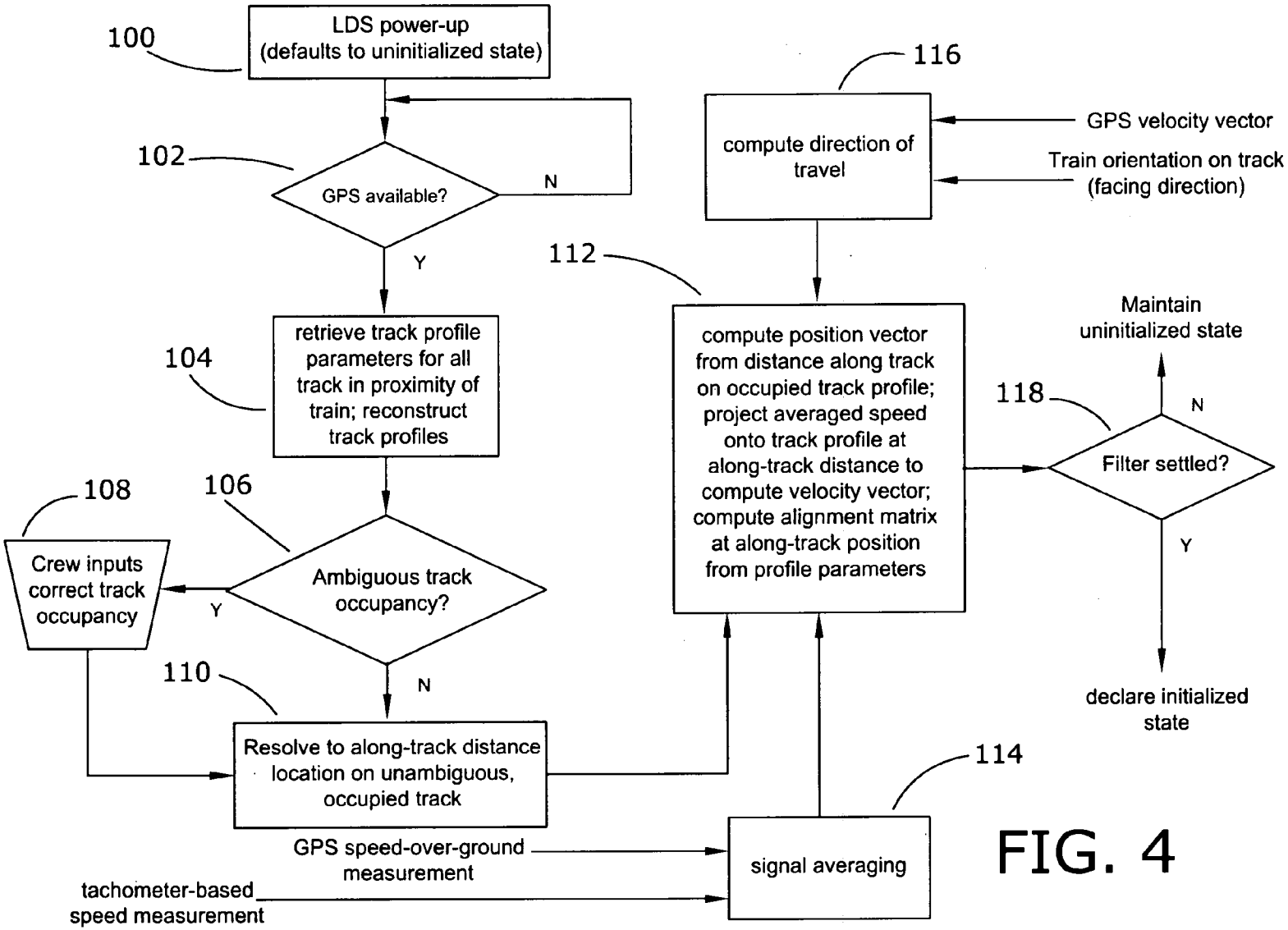
FIG. 4 is a simplied flow diagram illustrating the power-up/initialization sequence of the system of the present invention.

FIG. 4 is a simplified flow diagram illustrating the power-up/initialization sequence of the LDS 10; post start-up processing is described in subsequent figures.

As shown in FIG. 4, the system is powered-up at block 100 with the system defaulting to an uninitialized state. A query is presented at decision point 102 as to whether or not the GPS output is available. If the GPS output is not available, the process loops until such time that the GPS output is available.

At block 104 and thereafter, discrete profile parameters are retrieved to reconstruct the continuous track profile of all the track in the vicinity of the train. As mentioned above, the discrete profile parameters can be pre-stored in memory or downloaded as needed.

A query is then presented at decision point 106 to determine whether or not an ambiguous track occupancy condition exists (i.e., which track is occupied among two or more closely adjacent tracks). If an ambiguous track occupancy condition exists, the crew inputs the correct track occupancy value.

Thereafter, the along track distance is determined in block 110 and that along track distance value is supplied to the optimal estimator 112. In addition, a signal averaging functional block 114 accepts a GPS speed-over-ground value and a wheel tachometer-based value, applies an averaging operation in the functional block 114, and outputs an average along-track speed value to the optimal estimator 112. As shown in the upper part of FIG. 4, direction of travel function block 116 accepts the GPS velocity vector and a train orientation on the occupied track value to compute a direction of travel value that is presented to the optimal estimator 112.

The optimal estimator 112 sequentially processes the input values to converge toward a solution for the position vector and the velocity vector and an alignment matrix from the track profile parameters. At some point in the processing, a query is presented at decision point 118 as to whether or not the optimal estimator 112 has settled (i.e., converged to a optimal estimate). If the optimal estimator 112 is deemed to have successfully 'settled', the system is declared 'initialized'; otherwise the system is maintained in its initializing state.

As will be apparent to those skilled in the art, various changes and modifications may be made to the illustrated train location system and method of the present invention without departing from the spirit and scope of the invention as determined in the appended claims and their legal equivalent.

The invention claimed is:

1. A location system for locating the position of a locomotive on a trackway comprising:

an inertial sensor system for sensing linear and rotary acceleration associated with the movement of the locomotive over a trackway, said intertial sensor system having a first plurality of MEMS rate-of-turn rotary acceleration sensors having respective first sensitive axes and a second plurality of MEMS rate-of-turn acceleration sensors having respective second sensitive axes, the first and second sensitive axes oppositely aligned;

a sensor for determining, either directly or indirectly, distanced traveled over the trackway;

a radio-frequency based geo-positional receiver for at least periodically determining a geo-positional value for the locomotive;

an optimal estimator for accepting information on a continuous or periodic basis from the inertial sensor system, the distanced traveled sensor, and the geo-positional receiver and establishing a first computational instance and a second computational instance for determining the location of the locomotive as a function of information from the inertial sensor system, the distanced traveled sensor, and the geo-positional receiver.

2. The system of claim 1, further including a method of determining track occupancy upon passage by the locomotive through a turnout having a first and at least a second track leading therefrom, comprising the steps of:

establishing within said optimal estimator a first computational instance for the first track and a second computational instance for the second track using predetermined track parameters, each of the first and second computational instances computing location and corresponding estimated error states until one of the first and second computational instances exhibits pre-determined features in its estimated error states to indicate that the track for that instance is not the track occupied by the locomotive.

3. The system of claim 2, further comprising the step of:

ceasing the computational instance that exhibits predetermined features in its estimated error states indicating that track for that instance is not the track occupied by the locomotive.

4. The system of claim 1, wherein said inertial sensor system provides X and Y acceleration values and a Z turn rate value.

5. The system of claim 4, wherein said output of the inertial sensor system is subject to gravity model and/or sphereoid constraint correction.

6. The system of claim 1, wherein said distance traveled sensor comprises a wheel tachometer.

7. A method of determining track occupancy of a locomotive after the locomotive has passed through a turnout onto either of a first or at least a second track, comprising the steps of:

inertially sensing linear acceleration and turn rate associated with the movement of a locomotive over a trackway, the sensing step including combining turn rate information from a first plurality of MEMS turn rate sensors having respective first sensitive axis and a second plurality of MEMS turn rate sensors having respective second sensitive axis aligned in opposite directions;

determining, either directly or indirectly, distanced traveled over the trackway;

establishing, in an optimal estimator, a first computational instance for the first track and a second computational instance for the second track using predetermine track parameters, effecting the continued processing of each of the first and second computational instances computing at least the location of the locomotive and/or values related thereto by derivation or integration and the corresponding estimated error states until one of the first and second computational instances exhibits pre-determined features in its estimated error states indicating that the track for that instance is not the track occupied by the locomotive.

8. The method of claim 7, further comprising the step of:

ceasing the computational instance that exhibits predetermined features in its estimated error states indicating that track for that instance is not the track occupied by the locomotive.

9. A system for locating the position of a locomotive on a trackway comprising:

a strapdown inertial navigation system for providing at least linear and rotary acceleration associated with the movement of a locomotive over a trackway and at least a first integral thereof, said intertial sensor system having a first plurality of MEMS rate-of-turn rotary acceleration sensors having respective first sensitive axes and a second plurality of MEMS rate-of-turn acceleration sensors having respective second sensitive axes, the first and second sensitive axes oppositely aligned;

a sensor for determining, either directly or indirectly, distanced traveled along the trackway;

an optimal estimator for accepting information on a continuous or periodic basis from the strapdown inertial navigation system, the distanced traveled along the trackway sensor and establishing a first computational instance and a second computational instance for determining the location of the locomotive as a function of information from the strapdown inertial navigation system and the distanced traveled along the track sensor; and a radio-frequency based geo-positional receiver for at least periodically determining a geo-positional value for the locomotive.

10. The system of claim 9, further including a method of determining track occupancy upon passage by the locomotive through a turnout having at least a first and a second track leading therefrom, comprising the steps of:

determining a first computational instance for the first track and a second computational instance for the second track using predetermined track parameters, each of the first and second computational instances successively computing location and corresponding estimated error states until one of the first and second computational instances exhibits pre-determined features in its estimated error states indicating that track for that instance is not the track occupied by the locomotive.

11. The system of claim 9, further comprising the step of:

halting the computational instance that exhibits pre-determined features in its estimated error states indicating that track for that instance is not the track occupied by the locomotive.

* * * * *